US005492796A

United States Patent [19]

Ogiyama et al.

[11] Patent Number: 5,492,796

[45] Date of Patent: Feb. 20, 1996

[54] SILVER HALIDE COLOR PHOTOGRAPHIC MATERIAL AND PROCESSING METHOD THEREOF

[75] Inventors: Masashi Ogiyama; Seiji Ichijima, both of Kanagawa, Japan

[73] Assignee: Fuji Photo Film Co., Ltd., Kanagawa, Japan

[21] Appl. No.: 329,177

[22] Filed: Oct. 26, 1994

[30] Foreign Application Priority Data

Oct. 28, 1993 [JP] Japan ..... 5-271056

[51] Int. Cl.[6] ..... G03C 7/305; G03C 7/413; G03C 7/44

[52] U.S. Cl. ..... 430/380; 430/399; 430/467; 430/442; 430/543; 430/553; 430/555; 430/557; 430/558; 430/959; 430/963

[58] Field of Search ..... 430/543, 544, 430/553, 959, 380, 399, 551, 963, 442, 467, 484, 555, 557, 558

[56] References Cited

U.S. PATENT DOCUMENTS

| | | | |
|---|---|---|---|
| 3,265,499 | 8/1966 | Willems et al. | 430/484 |
| 3,265,502 | 8/1966 | Willems et al. | 430/484 |
| 4,409,323 | 10/1983 | Sato et al. | 430/544 |
| 4,477,560 | 10/1984 | Katabashi et al. | 430/553 |
| 4,526,863 | 7/1985 | Mihayashi et al. | 430/543 |
| 4,678,743 | 7/1987 | Yamada et al. | 430/551 |
| 4,741,994 | 5/1988 | Ichijima et al. | 430/549 |
| 4,912,025 | 3/1990 | Platt et al. | 430/380 |
| 4,977,073 | 12/1990 | Ishige et al. | 430/549 |
| 5,234,800 | 10/1993 | Begley et al. | 430/544 |
| 5,264,330 | 11/1993 | Yoshida et al. | 430/963 |
| 5,296,339 | 3/1994 | Fujita et al. | 430/399 |
| 5,346,809 | 9/1994 | Takada et al. | 430/963 |

FOREIGN PATENT DOCUMENTS

| | | |
|---|---|---|
| 51-26038 | 3/1976 | Japan . |
| 61-156126 | 7/1986 | Japan . |

*Primary Examiner*—Richard L. Schilling
*Attorney, Agent, or Firm*—Sughrue, Mion, Zinn, Macpeak & Seas

[57] ABSTRACT

A silver halide color photographic material having on a support at least one light-sensitive silver halide emulsion layer, wherein the color photogrphic material contains a nondiffusing coupler represented by formula (I):

$$Cp—(LINK)_n—N(R_1)—Ar(OR_2)—X \quad (I)$$

wherein Cp represents a coupler residue (residual group) which can undergo coupling reaction with the oxidation product of a color developing agent to release —$(LINK)_n$—$N(R_1)$—$Ar(OR_2)$—X; LINK represents a group which can release —$N(R_1)$—$Ar(OR_2)$—X after cleavage of bond to Cp; n represents 0 or an integar of 1 or 2, Ar represents an arylene group; X represents an amino group, an alkoxy group or a hydroxyl group; $R_1$ represents a hydrogen atom or a substituent; and $R_2$ represents an alkyl group or an aryl group and a method for processing the photographic material which comprises exposing, developing and bleaching the photographic material, wherein the replenishing amount for the developer is not more than 600 ml per square meter of the photographic material.

24 Claims, No Drawings

SILVER HALIDE COLOR PHOTOGRAPHIC MATERIAL AND PROCESSING METHOD THEREOF

FIELD OF THE INVENTION

The present invention relates to a silver halide color photographic material containing a coupler suitable for short-time processing and low-replenishing processing and also to a processing method of the color photographic material.

BACKGROUND OF THE INVENTION

Recently with the requirement of shortening a processing time, a color photographic light-sensitive material is required to give color images of a sufficient density within a shorter developing time. However, conventionally known techniques are not satisfactory and more improvements have been required. In particular, in a multilayer color photographic light-sesitive material, the development of the silver halide emulsion layer(s) disposed near the support is delayed and color images having a sufficient density are not obtained in short-time processing. That is, there is a problem that the development progress differs between the upper emulsion layer(s) and lower emulsion layer(s) and the color balance is unballanced.

As an attempt of obtaining a high color density by accelerating the development, couplers each releasing a color developing agent through a linkage group are known as described, e.g., in JP-A-61-156126 and JP-A-51-26038 (the term "JP-A" as used herein means an "unexamined published Japanese patent application"). However, even in the case of using these couplers, the color density obtained is not yet insufficient and a further improvement has been desired.

On the other hand, for the necessity of preventing the water pollution and the reduction of the processing cost, the technique of reducing the amount of waste liquids in photographic processing has been investigated. As one method thereof, there is a method of reducing the amount of the replenisher for a color developer and the practical use of the method has been investigated. The conventionally practiced replenishing amount of a color developer depends upon the kind of a color photographic material being processed and in the case of, for example, a color photographic negative film for photographing, the replenishing amount for a color developer is generally from 900 to 1200 ml per square meter of the color photographic film but recently with the requirement of low replenishing developing, the color development with a replenishing amount of about 600 ml has begun to be practiced.

However, when the processing time is shortened in the low replenishing processing, it becomes more difficult to obtain color images having a sufficient density.

SUMMARY OF THE INVENTION

A first object of the present invention is to provide a color photographic light-sensitive material capable of giving a sufficient color image density with a shorter time.

A second object of the present invention is to provide a color photographic light-sensitive material capable of giving a sufficient color image density with low replenishing process.

It has now been discovered that the above objects can be achieved by the present invention as described hereinbelow.

That is, according to the present invention, there is provided a silver halide color photographic material having at least one silver halide emulsion layer provided on a support, wherein the color photogrpahic material contains a nondiffusing coupler represented by the following formula (I):

$$Cp—(LINK)_n—N(R_1)—Ar(OR_2)—X \quad (I)$$

wherein Cp represents a coupler residue (residual group) which can undergo coupling reaction with the oxidation product of a color developing agent to release—$(LINK)_n$—$N(R_1)$—$Ar(OR_2)$—X; LINK represents a group which can release —$N(R_1)$—$Ar(OR_2)$—X after cleavage of bond to Cp; n represents an integer of 1 or 2, Ar represents an arylene group; X represents an amino group, an alkoxy group or a hydroxyl group; $R_1$ represents a hydrogen atom or a substituent; and $R_2$ represents an alkyl group or an aryl group.

DETAILED DESCRIPTION OF THE INVENTION

Then, the present invention is described in detail.

First, the coupler shown by the formula (I) is explained in detail.

When Cp represents a yellow color image-forming coupler residue, as such a coupler residue, there are, for example, pivaloylacetanilide coupler residues, benzoylacetanilide coupler residues, malondiester coupler residues, malondiamide coupler residues, dibenzoylmethane coupler residues, benzothiazolylacetamide coupler residues, malonestermonoamide coupler residues, triazolylacetamide coupler residues, benzimidazolylacetamide coupler residues , and cycloalkanoylaetamide coupler residues. Furthermore, the coupler residue may be the coupler residues described in U.S. Pat. Nos. 5,021,332 and 5,021,330 and European Patent 421,221A.

When Cp represents a magenta color image-forming coupler residue, as the coupler residue, there are, for example, 5-pyrazolone coupler residues, pyrazolobenzimidazole coupler residues, pyrazolotriazole coupler residues, pyrazoloimidazole coupler residues, and cyanoacetophenone coupler residues.

When Cp represents a cyan color image-forming coupler residue, as the coupler residue, there are, for example, phenol coupler residues and naphthol coupler residues. Furthermore, the coupler residues described in U.S. Patent No. 4,746,602 and European Patent 249,453A may be used as the coupler residue.

Furthermore, Cp may be a coupler residue which does not substantially leave color images. As the coupler residue of this type, there are, for example, indanone coupler residues, acetophenone coupler residues, and also the dissolving out-type coupler residues described in European Patents 443,530A and 444,501A.

The coupler residues which can be preferably used in the present invention are shown by the following formulae (Cp-1), (Cp-2), (Cp-3), (Cp-4), (Cp-5), (Cp-6), (Cp-7), (Cp-8), (Cp-9) and (Cp-10).

These couplers show a particularly high coupling speed and are preferred.

(Cp-1)

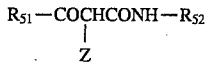

(Cp-2)

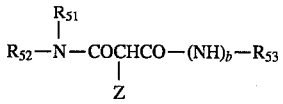

(Cp-3)

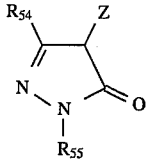

(Cp-4)

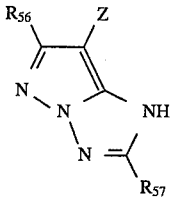

(Cp-5)

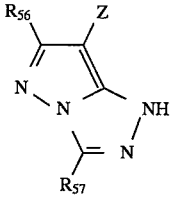

(Cp-6)

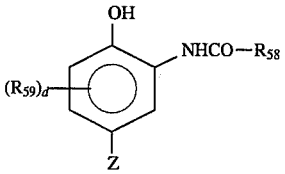

(Cp-7)

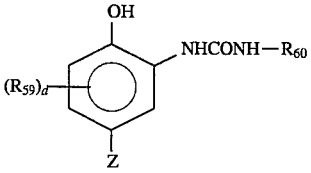

(Cp-8)

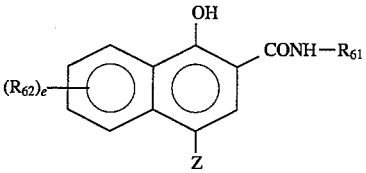

(Cp-9)

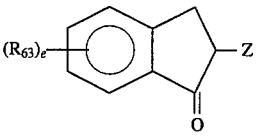

(Cp-10)

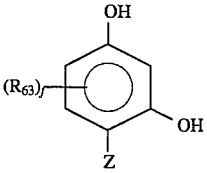

When in the above formulae, $R_{51}$, $R_{52}$, $R_{53}$, $R_{54}$, $R_{55}$, $R_{56}$, $R_{57}$, $R_{58}$, $R_{59}$, $R_{60}$, $R_{61}$, $_{62}$, or $R_{63}$ contains a nondiffusive group, the group is selected so that the total number of the carbon atoms becomes from 8 to 40, and preferably from 10 to 30 and in other cases, the total number of the carbon atoms is preferably not more than 15.

In the above formulae, Z represents —$(LINK)_n$—$N(R_1)$—$Ar(OR_2)$—X of formula (I).

In the case of a bis type coupler, a telomer type coupler, or a polymer type coupler, one of the foregoing groups $R_{51}$ to $R_{63}$ represents a divalent group and links to a repeating unit, etc. In this case, the range of the carbon number is outside the definition.

Then, $R_{51}$ to $R_{63}$, b, d, e, and f are explained in detail.

For the convenience of explaining $R_{51}$ to $R_{63}$, $R_{41}$ to $R_{45}$ are utilized. That is, $R_{41}$ represents an alkyl group, an aryl group, or a heterocyclic group; $R_{42}$ represents an aryl group or a heterocyclic group; and $R_{43}$, $R_{44}$, and $R_{45}$ each represents a hydrogen atom, an alkyl group, an aryl group, or a heterocyclic group.

In the above formulae, $R_{51}$ has the same meansing (definition) as $R_{41}$. $R_{52}$ and $R_{53}$ each has the same meaning as $R_{43}$. In the formulae, b represents 0 or 1. $R_{54}$ represents the group same as $R_{41}$, an $R_{41}CO(R_{43})N$— group, an $R_{41}SO_2(R_{43})N$— group, an $R_{41}(R_{43})N$— group, an $R_{41}S$— group, an $R_{43}O$— group, or an $R_{45}(R_{43})NCON(R_{44})$— group.

$R_{55}$ has the same meaning as $R_{41}$. $R_{56}$ and $R_{57}$ each represents the group same as $R_{43}$, an $R_{41}S$— group, an $R_{43}O$— group, an $R_{41}CO(R_{43})N$— group, an $R_{41}SO_2(R_{43})N$— group, an $R_{41}(R_{43})N$—, or an $R_{45}(R_{43})NCON(R_{44})$— group. $R_{58}$ has the same meaning as $R_{41}$. $R_{59}$ represents the same group as $R_{41}$, an $R_{41}CO(R_{43})N$— group, an $R_{41}OCO(R_{43})N$— group, an $R_{41}SO_2(R_{43})N$— group, an $R_{43}(R_{44})NCO(R_{45})N$— group, an $R_{41}O$— group, an $R_{41}S$— group, a halogen atom, or an $R_{41}(R_{43})N$— group. In the formulae, d represents 0 or an integer of from 1 to 3. When d is 2 or 3, plural $R_{59}$s may be same or a different.

$R_{60}$ has the same meaning as $R_{41}$. $R_{61}$ has the same meaning as $R_{41}$. $R_{62}$ repesents the same group as $R_{41}$, an $R_{41}OCONH$— group, an $R_{41}OCONH$— group, an $R_{41}SO_2NH$— group, an $R_{43}(R_{44})NCONH$— group, an $R_{43}(R_{44})NSO_2NH$— group, an $R_{43}O$— group, an $R_{41}S$— group, an $R_{41}CO(R_4)NSO_2$— group, a halogen atom, or an $R_{41}NH$— group.

$R_{63}$ represents the same group as $R_{41}$, an $R_{43}CO(R_{44})N$— group, an $R_{43}(R_{44})NCO$— group, an $R_{41}SO_2(R_{43})N$— group, $R_{41}(R_{43})NSO_2$— group, an $R_{41}SO_2$— group, an $R_{43}OCO$— group, an $R_{43}O$—$SO_2$— group, a halogen atom, a nitro group, a cyano group, or an $R_{43}CO$— group.

In formulae, e represents 0 or an integer of from 1 to 4 and f represents 0 or an integer of from 1 to 3. When $R_2$ or $R_{63}$ is plural, they may be the same or different.

In the above groups, the alkyl group is a, chain or cyclic, straight chain or branched alkyl group preferably having from 1 to 32, more preferably 1 to 22 carbon atoms. Specific examples of the alkyl group are a methyl, cyclopropyl, isopropyl, n-butyl, t-butyl, i-butyl, t-amyl, n-hexyl, cyclohexyl, 2-ethylhexyl, n-octyl, 1,1,3,3,-tetramethylbutyl, n-decyl, n-dodecyl, n-hexadecyl, and n-octadecyl groups.

The aryl group is preferably a substituted or unsubstituted phenyl or naphtyl group preferably having from 6 to 20 carbon atoms.

The heterocyclic group is preferably from 3-membered to 8-membered, substituted or unsubstituted heterocyclic group preferably having at least one of N, O and S atoms as hetero atom and preferably having from 1 to 20, and more preferably from 1 to 7 carbon atoms. The heterocyclic ring may be condensed with a benzene ring. Specific examples of the heterocyclic group are 2-pyridyl, 2-benzoxazolyl, 2-imidazolyl, 2-benzimidazolyl, 1-indolyl, 1,3,4-thiadiazol-2-yl, 1,2,4-triazol- 2-yl, and 1-indolynyl.

When the alkyl group, the aryl group, and the heterocyclic group described above have a substituent, as the substituent, there are a halogen atom (e.g., F, Cl, Br and I), an $R_{47}O$— group, $R_{46}S$— group, an $R_{47}CO(R_{48})N$— group, an $R_{47}(R_{48})NCO$— an $R_{46}OCO(R_{47})N$— group, an $R_{46}SO_2(R_{47})N$— group, an $R_{46}SO_2(R_{47})NCO$— group, an $R_{47}(R_{48})NSO_2$— group, an $R_{46}SO_2$— group, an $R_{47}OCO$— group, an $R_{47}NCO(R_{48})N$— group, an $R_{47}CONHSO_2$— group, an $R_{47}(R_{48})NCONHSO_2$— group, the group same as $R_{46}$, an $R_{47}(R_{48})N$— group, an $R_{46}COO$— group, an $R_{47}OSO_2$— group, a cyano group, and a nitro group, wherein $R_{46}$ represents an alkyl group, an aryl group, or a heterocyclic group and $R_{47}$ and $R_{48}$ each represents an alkyl group, an aryl group, a heterocyclic group, or a hydrogen atom. The alkyl group, the aryl group, and the heterocyclic group described above have the same meanings as defined above.

Then, the preferred scopes of $R_{51}$ to $R_{63}$, b, d, e, and f are explained.

$R_{51}$ is preferably an alkyl group, an aryl group, or a heterocyclic group. $R_{52}$ and $R_{55}$ are preferably an aryl group. $R_{53}$ is preferably an aryl group when b is 1 and is preferably a heterocyclic group when b is 0. Preferred b is 0. $R_{54}$ is preferably an $R_{41}CONH$— group or an $R_{41}(R_{43})N$— group. $R_{56}$ and $R_{57}$ are preferably an alkyl group, an $R_{41}O$— group, or an $R_{41}S$— group.

$R_{58}$ is preferably an alkyl group or an aryl group. In the formula (Cp-6), $R_{56}$ is preferably a chlorine atom, an alkyl group, or an $R_{41}CONH$— group. Furthermore, d is preferably 1 or 2. $R_{60}$ is preferably an aryl group.

In the formula (Cp-7), $R_{59}$ is preferably an $R_{41}CONH$— group. In the formula (Cp-7), d is preferably 1. $R_{61}$ is preferably an alkyl group or an aryl group.

In the formula (Cp-8), e is preferably 0 or 1. $R_{62}$ is preferably an $R_{41}OCONH$— group, an $R_{41}CONH$— group, or an $R_{41}SO_2NH$— group. A preferred substitution position is the 5-position of the naphthol ring.

In the formula (Cp-9), e is preferably 1 and $R_{63}$ is preferably an $R_{41}CONH$— group, an $R_{41}SO_2NH$— group, an $R_{41}(R_{43})NSO_2$— group, an $R_{41}SO_2$— group, or an $R_{41}(R_{43})NCO$— group.

In the formula (Cp-10), f is preferably 1 and $R_{63}$ is preferably an $R_{43}NHCO$— group, an $R_{43}OCO$— group, or an $R_{43}CO$— group.

The group represented by LINK will be further described hereinafter.

The group represented by LINK may be any linking group which can release —$N(R_1)$—$Ar(OR_2)$—X after the cleavage of bond to Cp during development. Examples of such a linking group include groups utilizing hemiacetal cleavage reaction as disclosed in U.S. Pat. Nos. 4,146,396, 4,652,516, and 4,698,297, timing groups utilizing intramolecular nucleophilic substitution reaction to cause cleavage reaction as disclosed in U.S. Pat. Nos. 4,248,962, 4,847,185, 4,912, 028, and 4,857,440, timing groups utilizing electron transfer reaction to cause cleavage reaction as disclosed in U.S. Pat. Nos. 4,409,323, 5,034,311, 5,055,385, and 4,421,845, groups utilizing iminoketanol hydrolysis reaction to cause cleavage reaction as disclosed in U.S. Pat. No. 4,546,073, and groups utilizing ester hydrolysis reaction to cause cleavage reaction as disclosed in west German Patent Application (OLS) No. 2,626,317. If two LINK's are connected (n=2), examples of the group represented by LINK include timing groups as disclosed in U.S. Pat. Nos. 4,861,701, 5,026,628, and 5,021,322, and EP 499,279A and 438,129A. LINK may also be a group which releases two —$N(R_1)$—$Ar(OR_2)$—X groups. Examples of such a group include timing groups as disclosed in EP 464,612A.

LINK is connected to Cp via hetero atom contained therein, preferably oxygen atom, sulfur atom or nitrogen atom.

Preferred examples of the group represented by LINK include those represented by the following general formulae (T-1) and (T-2):

$$*—W—(Y=Z)_j—C(R_{21})R_{22}—** \quad (T—1)$$

$$*—W—R_3—E—** \quad (T-2)$$

wherein * represents the position at which LINK is connected to Cp in the general formula (I); ** represents the position at which LINK is connected to —$N(R_1)$—$Ar(OR_2)$—X or LINK (when n is plural); W represents an oxygen atom, a sulfur atom or >N-$R_{23}$; Y and Z each represent a methine or a nitrogen atom; j represents 0 or an integer of from 1 or 2; $R_{21}$, $R_{22}$ and $R_{23}$ each represent a hydrogen atom or a substituent; E represents an electrophilic group; and $R_3$ represents a linking group which makes a steleostructual relationship between W and E so that they can undergo intramolecular nucleophilic substitution reaction, with the proviso that when Y and Z each represent a substituted methine group, any two of the substituents, $R_{21}$, $R_{22}$ and $R_{23}$ may be connected to each other to form a cyclic structure (e.g., benzene ring, pyrazole ring).

Specific examples of LINK will be listed below.

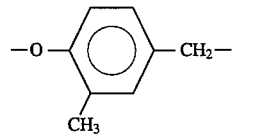

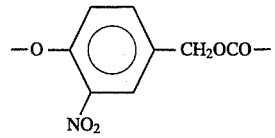

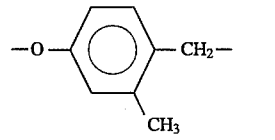

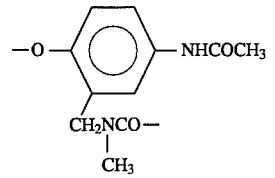

-continued

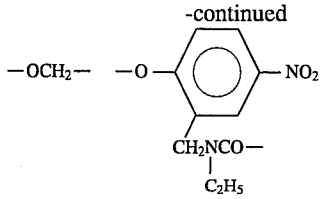

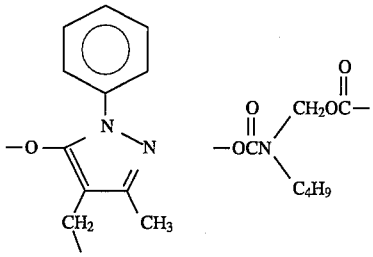

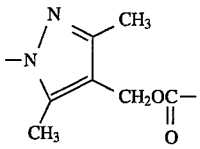

In the formula (I) described hereinbefore, when $R_1$ represents a substituent, as the substituent, there are preferably an alkoxycarbonyl group (preferably having from 2 to 30, and more preferably from 2 to 20 carbon atoms, such as, for example, methoxycarbonyl, dodecyloxycarbonyl, and hexadecyloxycarbonyl), an unsubstituted sulfamoyl group, an alkyl-, aryl- and N-acyl- (in the present invention an acyl group or moiety includes an aliphatic and aromatic acyl group or moiety, respectively) sulfamoyl groups (preferably having from 1 to 30 carbon atoms, and more preferably from 1 to 20 carbon atoms, such as, for example, N-butylsulfamoyl, N-dodecylsulfamoyl, N,N-diethylsulfamoyl, N-propanoylsulfamoyl, N-tetradecanoylsulfamoyl, and N-benzoylsulfamoyl), a sulfonyl group such as an alkyl- and arylsulfonyl groups (preferably having from 1 to 30 carbon atoms, and more preferably from 1 to 20 carbon atoms, such as, for example, methanesulfonyl, octanesulfonyl, benzenesulfonyl, and dodecanesulfonyl), an alkyl group (a straight chain, branched, or cyclic alkyl group preferably having from 1 to 30, and more preferably from 1 to 20 carbon atoms, such as, for example, methyl, ethyl, isopropyl, cyclopropyl, t-pentyl, t-octyl, cyclopentyl, t-butyl, s-butyl, dodecyl, and 2-hexyldecyl), an aryl group (preferably having from 6 to 20, and more preferably from 6 to 10 carbon atoms, such as, for example, phenyl, naphthyl, and 4methoxyphenyl), and an acyl group (preferably having from 1 to 30, and more preferably from 2 to 20 carbon atoms, such as, for example, acetyl and benzoyl). As shown in parentheses above these substituents may be further substituted with at least one of these substituents.

In the formula (I), the group shown by Ar is an arylene group having not any substituent other than $OR_2$ or an arylene group which is further substituted with at least one substituent. The arylene group preferably having from 6 to 20, and more preferably 6 to 10 carbon atoms, such as, preferably, 1,4-phenylene, 1,2-phenylene, 1,4-naphthylene, and 1,2-naphthylene groups which may further have at least one substituent other than $OR_2$.

When the group shown by Ar has further at least one substituent, examples of the substituent are a halogen atom (e.g., fluorine and chlorine), an acylamino group (preferably having from 2 to 30, and more preferably from 2 to 20 carbon atoms, such as, for example, acetamido and benzamido), a sulfonamido group such as an alkyl- and arylsulfonamido groups (preferably having from 1 to 30, and more preferably from 1 to 20 carbon atoms, for example, methanesulfonamido and benzenesulfonamido), an alkoxy group (preferably having from 1 to 30, and more preferably from 1 to 20 carbon atoms, such as, for example, methoxy, hexadecyloxy, and isopropoxy), an aryloxy group (preferably having from 6 to 20, and more preferably from 6 to 10 carbon atoms, such as, for example, phenoxy, 4-methoxyphenoxy, and naphthoxy), an alkoxycarbonylamino group (preferably having from 2 to 30, and more preferably from 2 to 20 carbon atoms, such as, for example, ethoxycarbonylamino and tetradecyloxycarbonylamino), —COOM and —$SO_3M$ (wherein M represents a hydrogen atom, an alkali metal atom such as Li, Na and K, or $NH_4$), a hydroxy group, an alkylthio group (preferably having from 1 to 30, and more preferably from 1 to 20 carbon atoms, such as, for example, methylthio, dodecylthio, and dodecylcarbamoylmethylthio), a ureido group (preferably having from 1 to 30, and more preferably from 1 to 20 carbon atoms, such as, for example, N-phenylureido and N-butylureido), an aryl group (preferably having from 6 to 20, and more preferable from 6 to 10 carbon atoms, such as, for example, phenyl, naphthyl, and 4-methoxyphenyl), a heterocyclic group (a 3- to 12-membered, and preferably 5- or 6-membered monocyclic or condensed ring (e.g., with a benzene ring) preferably having from 1 to 20, and more preferably from 1 to 10 carbon atoms and containing at least one of, for example, nitrogen, oxygen, and sulfur as a hetero atom, such as, for example, 2-pyridyl, 4-pyridyl, 4-pyrimidinyl, 3-pyrazolyl, 1-pyrrolyl, 2,4-dioxo-1,3-imidazolidin- 1-yl, morpholino, and indolyl), an alkyl group (a straight chain, branched, or cyclic alkyl group preferably having from 1 to 30, and more preferably from 1 to 20 carbon atoms, such as, for example, methyl, ethyl, isopropyl, cyclopropyl, t-pentyl, t-octyl, cyclopentyl, t-butyl, s-butyl, dodecyl, and 2-hexyldecyl), an arylthio group (preferably having from 6 to 20, and more preferably from 6 to 10 carbon atoms, such as, for example, phenylthio and naphthylthio), and a sulfamoylamino group such as an alkyl-, aryl and acylsulfamoylamono groups (preferably having from 0 to 30, and more preferably from 0 to 20 carbon atoms, such as, for example, N-butylsulfamoylamino, N-dodecylsulfamoylamino, and N-phenylsulfamoylamino). As indicated in parentheses above these substituents may be further substituted with at least one of these substituents.

In the general formula (I), the alkyl group represented by $R_2$ is straight-chain, branched or cyclic alkyl group preferably having 1 to 20, more preferably 1 to 10 carbon atoms. Examples of such an alkyl group include methyl, ethyl, isopropyl, cyclopropyl, cyclopentyl, and s-butyl.

In the general formula (I), the aryl group represented by $R_2$ is a substituted or unsubstituted aryl group preferably having 6 to 20, more preferably 6 to 10 carbon atoms. Examples of substituents include an alkyl group preferably having from 1 to 6 carbon atoms (e.g., methyl, ethyl, propyl, isopropyl, t-butyl, t-amyl), an alkoxy group preferably having from 1 to 6 carbon atoms (e.g., methoxy, ethoxy), and a halogen atom (e.g., F, Cl and Br). Examples of the aryl group include a phenyl group, a naphthyl group, and a 4-methoxyphenyl group.

When the group shown by X in the formula (I) represents an amino group, examples of the amino group are an unsubstituted amino group, an alkyl-substituted amino group (including an N- containing heterocyclic group formed by connecting two substituents of the amino group)

(preferably having from 1 to 30, and more preferably from 2 to 10 carbon atoms, such as, for example, dimethylamino, diethylamino, N-ethyl-N-methanesulfonamidoethylamino, N-ethyl-N-hydroxyethylamino, N,N-bis(3-hydroxypropyl)amino, N,N-bis(2-hydroxyethyl)amino, dipropylamino, N-methyl-N-ethylamino, morpholino, pyrrolidino, and dibutylamino), and an arylamino group (preferably having from 6 to 20, and more preferably from 6 to 10 carbon atoms, such as, for example, anilino, M-methylanilino, and N-methylnaphthylamino). As shown in parentheses above the alkyl and aryl moieties in the alkyl- or aryl- substituted amino group may be further substituted with at least one of substituents such as those recited as substituents for Ar.

When the group shown by X in the formula (I) represents an alkoxy group, the alkoxy group is a substituted or unsubstituted alkoxy group preferably having from 1 to 30, and more preferably from 1 to 20 carbon atoms. Examples of the alkoxy group are same as those explained above as the substituents for At. When X is an alkyl-substituted amino group or is an alkoxy group, a carbon atom of these substituents represented by X may be connected with a carbon atom (of the benzene ring) adjacent to the X-connected carbon atom of the banzen ring to form a 5- to 7-membered ring.

The coupler shown by the formula (I) is a nondiffusing coupler. A nondiffusing coupler is a coupler having a group sufficiently increasing the molecular weight of the molecule for making the coupler molecule immobile in the layer containing the coupler. As such a group, an alkyl group having from 8 to 30, and preferably from 10 to 20 total carbon atoms or an aryl group having a substituent having from 4 to 20 total carbon atoms is usually used. Such a nondiffusing group may be substituted to any position of the molecule or the molecule has plural such nondiffusing groups.

Then, the preferred scope of the coupler shown by the formula (I) is explained.

When Ar in the formula (I) is a phenylene group having no substituent other than $OR_2$ or a phenylene group having at least one of an alkyl group, an alkoxy group, and an acylamino group, in addition to $OR_2$ effect of the present invention is remarkable and thus is preferable in this invention.

In a particularly preferred embodiment of the general formula (I), the ortho position with respect to $NR_1$ on Ar is substituted by —$OR_2$ or alkyl group (in this case —$OR_2$ is on a position other than the ortho position).

In a preferred embodiment of the general formula (I), X is an amino group substituted with an alkyl group. In a particularly preferred embodiment, X is in the ortho position with respect to $NR_1$ on Ar.

Also, $R_1$ in the formula (I) is particularly preferably a hydrogen atom or a sulfonyl group.

Then, specific examples of the nondiffusing coupler being used in the present invention are illustrated below but the invention is not limited by the compounds.

(1)

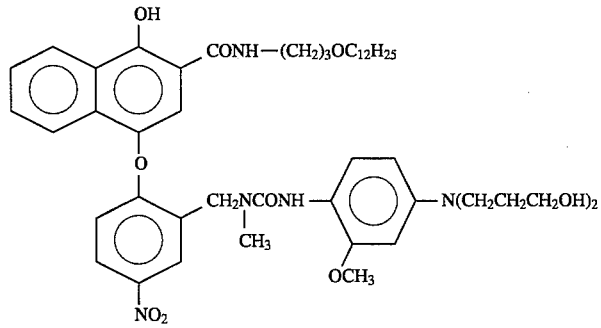

(2)

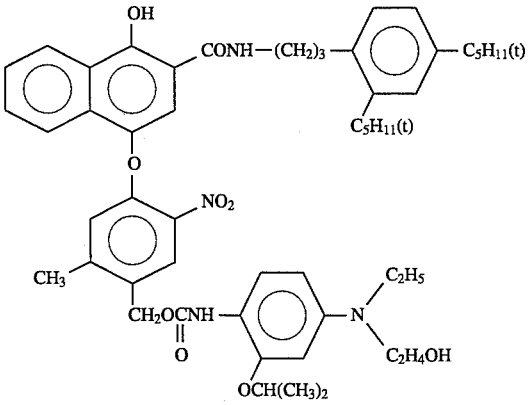

(3)

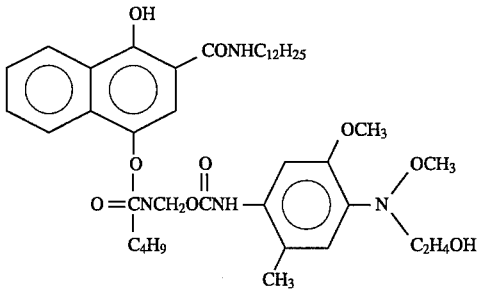

-continued
(4)
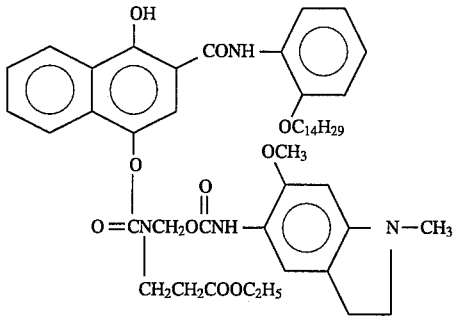
(5)
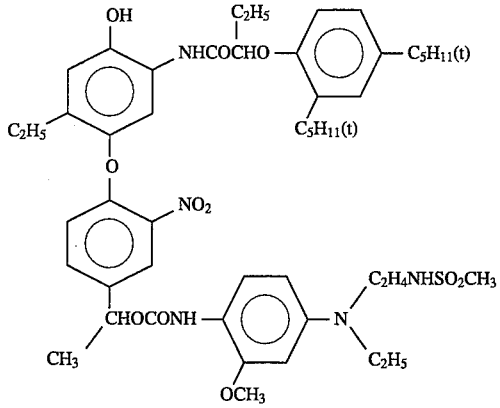
(6)
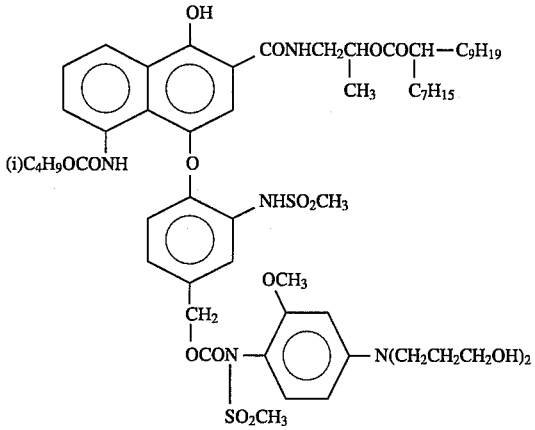
(7)
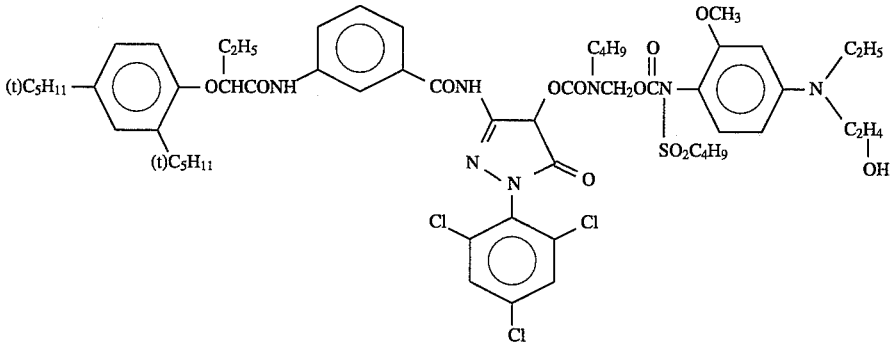
(8)
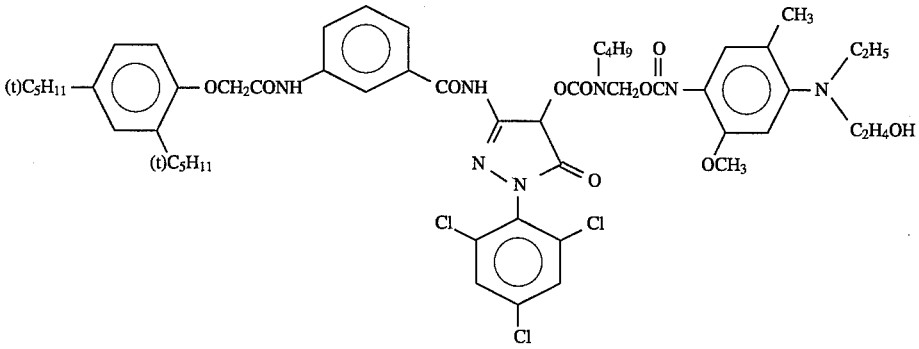

-continued
(9)
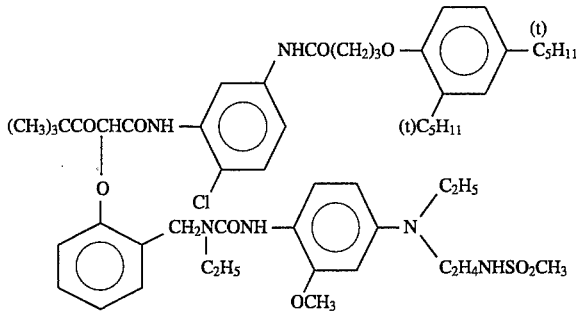
(10)
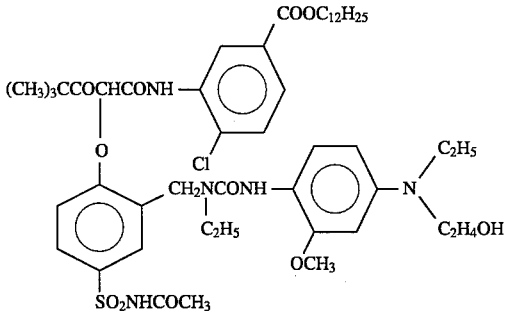
(11)
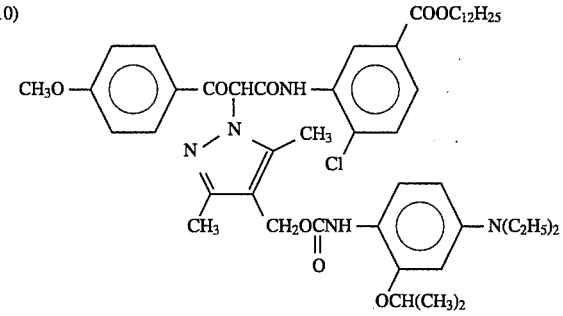
(12)
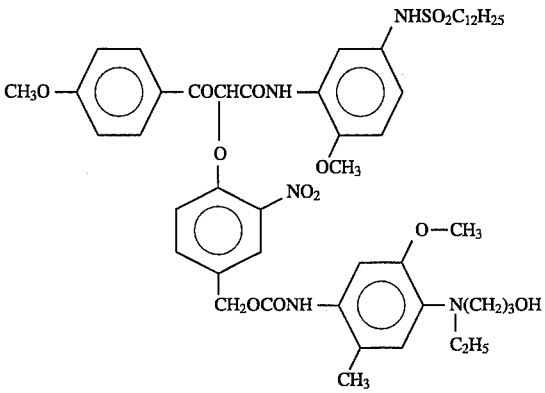
(13)
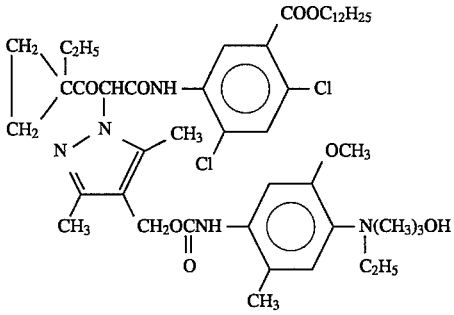
(14)
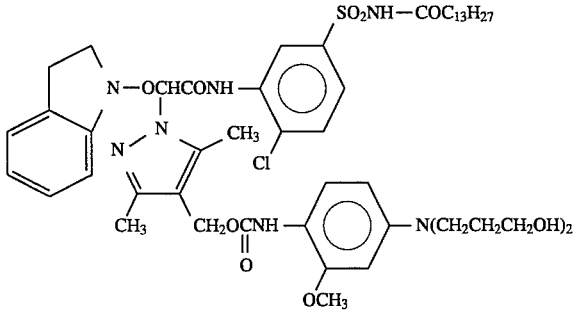
(15)
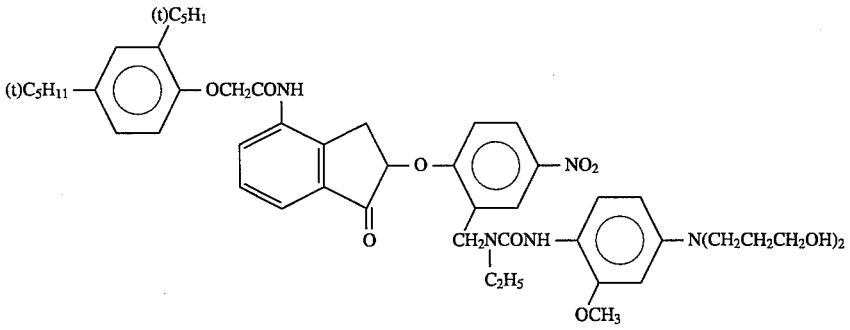

-continued
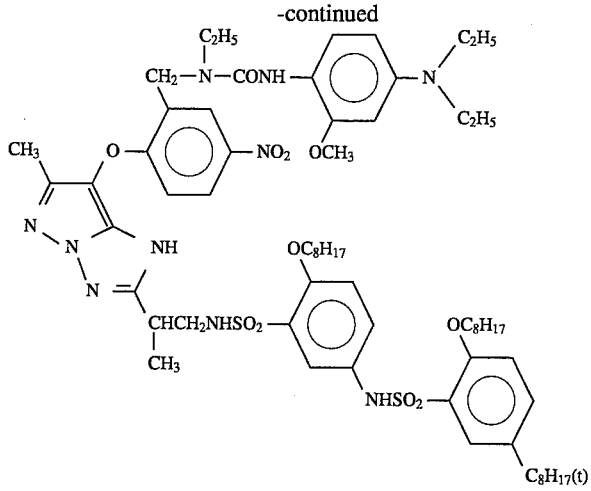
(16)
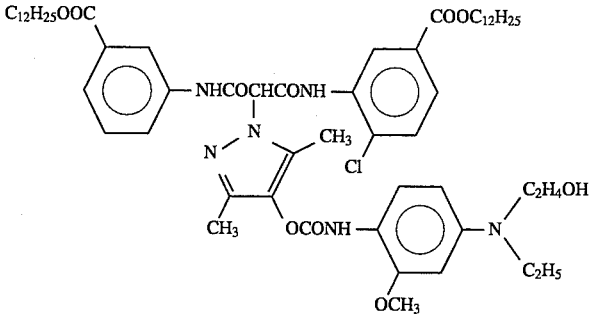
(17)
Specific examples of method for the synthesis of the compound of the present invention will be described below. Other compounds can be synthesized by similar or analogous methods.
SYNTHESIS EXAMPLE 1
Synthesis of Exemplary Compound (11)
Exemplary Compound (11) was synthesized by the following synthesis method:
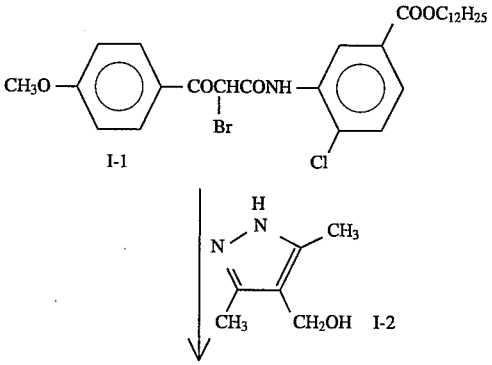
-continued
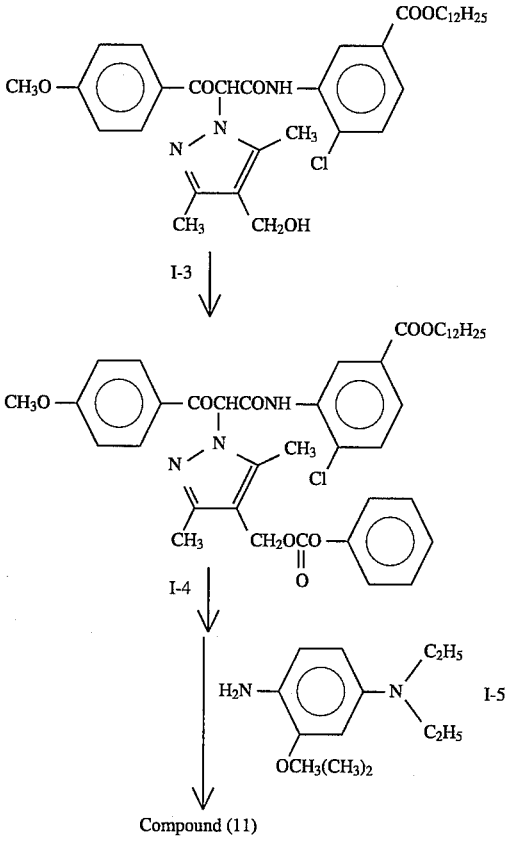

Step i Synthesis of Compound I-3

30 g of Compound I-1 and 12.6 g of Compound I-2 were dissolved in 200 ml of N,N-dimethylacetamide. The reaction solution was then allowed to undergo reaction at a temperature of 40° C. for 3 hours. To the reaction solution was then added 500 ml of ethyl acetate. The reaction solution was washed with water in a separatory funnel. The solvent was then distilled off under reduced pressure. The residue was then crystallized from acetonitrile to obtain 25.8 g of Compound I-3.

Step ii Synthesis of Compound I-4

25.8 g of Compound I-3 thus obtained and 4.5 g of pyrazine were dissolved in 200 ml of tetrahydrofuran. The reaction solution was then cooled with ice. To the reaction solution was then added dropwise 7.6 g of phenyl chloroformate. After the completion of dropwise addition, the reaction mixture was allowed to undergo reaction for 30 minutes.

To the reaction solution was then added 300 ml of ethyl acetate. The reaction solution was transferred into a separatory funnel whereit was then washed with water. The resulting oil phase was then recovered. It was entirely used in the subsequent step.

Step iii Synthesis of Exemplary Compound (11)

To the ethyl acetate solution thus obtained was then added 9.0 g of Compound I-5. The reaction solution was allowed to undergo reaction at room temperature for 4 hours and then at a temperature of 40° C. for 1 hour. The reaction was effected in an atmosphere of nitrogen. After the completion of reaction, the reaction solution was transferred into a separatory funnel where it was then washed with water, dilute hydrochloric acid, and then water. The resulting oil phase was recovered. The solvent was then distilled off under reduced pressure. The residue was then crystallized from acetonitrile to obtain 22.3 g of the desired exemplary Compound (11).

Other couplers represented by formula (I) such as compounds (1), (15) and (16) may be synthesized according to the method for production of a coupler which releases a photographically useful group (PUG), which is disclosed in British Patent 2,010,818.

The coupler of the present invention shown by the formula (I) described above can be added to any light-sensitive silver halide emulsion layer or a layer adjacent to an emulsion layer but, in particular, it is preferred to add the coupler to a light-sensitive silver halide emulsion layer. When the silver halide emulsion layer is an unit comprising 2 or more silver halide emulsion layers having the same color sensitivity but different photographic speeds, it is preferred that the coupler is incorporated into the emulsion layer having the lowest speed.

The coupler may be added to a hydrophilic colloidal layer adjacent to an emulsion layer. Examples of the hydrophilic colloidal layer include an intermediate layer, an antihalation layer, an irradiation preventing layer and a protective layer.

The total addiion amount of the coupler to the color photographic material is preferably from 0.0001 to 1.50 $g/m^2$, more preferably from 0.01 to 1.20 $g/m^2$, and particularly preferably from 0.1 to 1.0 $g/m^2$.

The photographic material of the present invention is not specifically defined, provided that it has at least one light-sensitive layer on a support. As one typical example, there is mentioned a silver halide photographic material having on a support at least one light-sensitive layer composed of plural silver halide emulsion layers each having substantially the same color-sensitivity but having a different sensitivity degree. The light-sensitive layer is a unit light-sensitive layer having a color-sensitivity to anyone of blue light, green light and red light. In a multi-layer silver halide color photographic material, in general, the order of the light-sensitive layer units comprises a red-sensitive layer unit, a green-sensitive layer unit and a blue-sensitive layer unit formed on the support in this order. As the case may be, however, the order may be opposite to the above-mentioned one, depending on the object of the photographic material. As still another embodiment, a different color-sensitive layer may be sandwiched between other two and the same color-sensitive layers. Light-insensitive layers may be provided between the above-mentioned silver halide light-sensitive layers or may be provided as an uppermost layer and/or a lowermost layer. These layers may contain couplers, DIR compounds, color mixing preventing agents and others which will be mentioned hereunder. As described in DE 1,121,470 and GB 923,045, the plural silver halide emulsion layers constituting a respective light-sensitive layer unit, preferably is a two-layered constitution composed of a high-sensitivity emulsion layer and a low-sensitivity emulsion layer arranged on the support in such a way that the sensitivity degree of the layer is to gradually decrease in the direction to the support. As another embodiment, a low-sensitivity emulsion layer is formed remote from the support while a high-sensitivity emulsion layer is formed near to the support, as described in JP-A 57-112751, 62-200350, 62-206541, and 62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B 55-34932; and an order of blue-sensitive layer/GL/RL/GH/RH from the remotest side from the support, as described in JP-A 56-25738 and 62-63936.

As further example, there is a three-layer unit constitution as described in JP-B 49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, the sensitivity degree of each emulsion layer is gradually lowered to the direction of the support. Even in such a three-layer constitution having the same color-sensitivity, the layers may be composed of middle-sensitivity emulsion layer/high-sensitivity emulsion layer/low-sensitivity emulsion layer formed in this order from the remotest side from the support, as described in JP-A 59-202464.

As still other examples of the layer constitution of the photographic material of the present invention, there are mentioned an order of high-sensitivity emulsion layer/low-sensitivity emulsion layer/middle-sensitivity emulsion layer/, and an order of low-sensitivity emulsion layer/middle-sensitivity emulsion layer/high-sensitivity emulsion layer. Where the photographic material of the invention has four or more layers, the layer constitution thereof may be varied in accordance with the manner mentioned above.

In order to improve the color reproducibility, it is desired to provide a doner layer (CL) which has an interlayer effect and which has a color sensitivity distribution different from that of the essential light-sensitive layers of BL, GL and RL, adjacent to or near to the essential light-sensitive layers, in the manner as described in U.S. Pat. Nos. 4,663,277, 4,705,744 and 4,707,436 and JP-A 62-160448 and 63-89850.

Silver halides preferably used in the present invention are silver iodobromides, silver iodochlorides or silver iodochlorobromides having a silver iodide content of about 30 mol % or less. Especially preferred are silver iodobromides or silver iodochlorobromides having a silver iodide content of from about 2 mol % to about 10 mol %.

The silver halide grains in the photographic emulsion constituting the photographic material of the present invention may be regular crystallines such as cubic, octahedral or tetradecahedral grains, or irregular crystallines such as spherical or tabular grains, or irregular crystallines having a crystal defect such as a twin plane, or composite crystallines composed of the above-mentioned regular and irregular crystalline forms.

Regarding the grain size of the silver halide grains, the grains may be fine grains having a small grain size of about 0.2 microns or less as the diameter of the projected area or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in Research Disclosure (hereinafter referred to as RD) No. 17643 (December, 1978), pages 22 to 23 (I. Emulsion Preparation and Types); RD No. 18716 (November, 1979), pages 648; RD No. 307105 (November 1989), pages 863 to 865; P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and GB 1,413,748 are also preferably used in the present invention.

Additionally, tabular grains having an aspect ratio of about 3 or more may also be used in the present invention. Tabular grains may easily be prepared in accordance with various methods, for example, as described in Gutoff, *Photographic Science and Engineering*, Vol. 14, pages 248 to 257 (1970); and U.S. Pat. Nos. 4,434,226, 4,414,310, 4,430,048, and 4,439,520 and GB 2,112,157.

Regarding the crystal structure of the silver halide grains, the grains may have the same halogen composition throughout the whole grain, or they may have different halogen compositions between the inside part and the outside part of one grain, or they may have a layered structure. Further, the grains may have different halogen compositions conjugated by epitaxial bond, or they may conjugated with other compounds than silver halides, such as silver rhodanide or lead oxide. Additionally, a mixture of various grains of different crystalline forms may be employed in the present invention.

The above-mentioned emulsions for use in the present invention may be either surface latent image type ones of forming latent images essentially on the surfaces of the grains or internal latent image type ones of forming latent images essentially in the insides of them, or may also be surface/inside latent image type ones of forming a latent images both on the surfaces of the grains and in the insides of them. Anyhow, the emulsions are needed to be negative emulsions. As an internal latent image type emulsion, it may be a core/shell type internal latent image type emulsion as described in JP-A 63-264740. A methods of preparing such emulsions is described in JP-A 59-133542. The thickness of the shell of the emulsion grains of the type varies depending on the way of developing them, and is preferably from 3 to 40 nm, especially preferably from 5 to 20 nm.

The emulsions are generally physically ripened, chemically ripened and/or spectrally-sensitized. Additives to be used in such a ripening or sensitizing step are described in RD Nos. 17643, 18716 and 307105, and the related descriptions in these references are shown in the table mentioned below.

In the photographic material of the present invention, two or more emulsions which are different from one another in at least one characteristic of light-sensitive silver halide emulsions, such as the grain size, the grain size distribution, the halogen composition, the shape and the sensitivity of the grains, can be incorporated into the same layer.

Surface-fogged silver halide grains as described in U.S. Pat. No. 4,082,553; inside-fogged silver halide grains as described in U.S. Pat. No. 4,626,498 and JP-A 59-214852; as well as colloidal silver may preferably be used into light-sensitive silver halide emulsion layers and/or substantially non-light-sensitive hydrophilic colloid layers. Inside-fogged or surface fogged silver halide grains are such grains that can be non-imagewise uniformly developed irrespective of the non-exposed area and the exposed area of the photographic material. Method of preparing them are described in U.S. Pat. No. 4,626,498 and JP-A 59-214852. The silver halide of forming the inside nucleus of an inside-fogged core/shell type silver halide grain may have a different halogen composition. The inside-fogged or surface-fogged silver halide may be any of silver chloride, silver chlorobromide, silver iodobromide or silver chloroiodobromide. The mean grain size of such fogged silver halide grains is preferably from 0.01 to 0.75 μm, especially preferably from 0.05 to 0.6 μm. The grains may be regular ones. The emulsion containing them may be either a monodispersed one or a polydispersed one. Preferred is a monodispersed one, in which at least 95% by weight or by number of the silver halide grains therein have a grain size to fall within the range of the mean grain size ±40%.

The photographic material of the present invention preferably contain non-light-sensitive fine silver halide grains. Non-light-sensitive fine silver halide grains are fine silver halide grains which are not sensitive to the light as imparted to the photographic material for imagewise exposure thereof and are substantially not developed in the step of development processing. These fine grains are desired not previously fogged. The fine silver halide grains have a silver bromide content of from 0 to 100 mol % and, if desired, they may additionally contain silver chloride and/or silver iodide. Preferably, they contain silver iodide in an amount of from 0.5 to 10 mol %. The fine silver halide grains are desired to have a mean grain size (as a mean value of the diameters of the circles corresponding to the projected areas of the grains) of from 0.01 to 0.5 μm, more preferably from 0.02 to 0.2 μm.

The fine silver halide grains may be prepared by the same methods as those of preparing ordinary light-sensitive silver halide grains. The surfaces of the fine silver halide grains do not need to be optically seisitized and spectral sensitization of the grains is unnecessary. However, prior to addition of the fine grains to the coating composition, it is desired to previously add a known stabilizer, such as triazole compounds, azaindene compounds, benzothiazolium compounds, mercapto compounds or zinc compounds, to the coating composition. The fine silver halide grains-containing layer may contain colloidal silver.

The total coated amount of silver (silver in light-sensitive and light-insensitive silver halide and colloidal silver) in the photographic material of the present invention is preferably 6.0 g/m$^2$ or less, most preferably 4.5 g/m$^2$ or less.

Various known photographic additives which may be used in the present invention are mentioned in RD's, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Spectrally Sensitizing Agent Super Sensitizing Agent | pages 23 to 24 | page 648, right column, to page 649, right column | pages 866 to 868 |
| 4 Brightening Agent | page 24 | page 647, right column | page 868 |
| 5 Light Absorbent Filter Dye Ultraviolet Absorbent | pages 25 to 26 | page 649, right column to page 650, left column | page 873 |
| 6 Binder | page 26 | page 651, left column | page 873 to 874 |
| 7 Plasticizer, Lubricant | page 27 | page 650, right column | page 876 |
| 8 Coating Aid Surfactant | pages 26 to 27 | page 650, right column | pages 875 to 876 |
| 9 Antistatic Agent | page 27 | page 650, right column | pages 876 to 877 |
| 10 Mat Agent | | | pages 878 to 879 |

Various color couplers can be incorporated into the photographic material of the present invention. The following couplers are especially preferred.

Yellow Couplers:

Couplers of formulae (I) and (II) in EP 502,424A; couplers of formulae (1) and (2) in EP 513,496A (especially, Y-28 in page 18); couplers of formula (I) stated in claim 1 of JP-A 5-307248; couplers of formula (I) in U.S. Pat. No. 5,066,576, column 1, lines 45 to 55; couplers of formula (I) in column 0008 in JP-A 4-274425; couplers stated in claim 1 of EP 498,381A1, page 40 especially D-35 in page 18; couplers of formula (Y) in EP 447,969A1, page 4 (especially, Y-1 in page 17 and Y-54 in page 41); couplers of formulae (II) to (IV) in U.S. Pat. No. 4,476,219, column 7, lines 36 to 58 (especially, II-17 and 19 in column 17 and II-24 in column 19).

Magenta Couplers:

In JP-A 3-39737, L-57 (Page 11, right bottom column), L-68 (page 12, right bottom column), L-77 (page 13, right bottom column); in EP 456,257, [A-4]-63 (page 134), [A-4]-73 and [A-4]-75 (page 139); in EP 486,965, M-4 and M-6 (page 26), M-7 (page 27); in JP-A 6-43611, column 0024, M-45; in JP-A 5-204106, column (0036), M-1; in JP-A 4-362631m cikynb (0237) M-22.

Cyan Couplers:

In JP-A 4-204843, CX-1, 3, 4, 5, 11, 12, 14 and 15 (page 14 to 16); in JP-A 4-43345, C-7 and C-10 (page 35), C-34 and C-35 (page 37), (I-1) and (I-17) (pages 42 to 43); couplers of formulae (Ia) and (Ib) in claim 1 of JP-A 6-67385.

Polymer Couplers:

P-1 and P-5 in JP-A 2-44345, page 11.

Couplers capable of forming colored dyes with pertinent diffusibility may also be used, and those described in U.S. Pat. No. 4,366,237, GB 2,125,570, EP 96,570, and DE 3,234,533 are preferred.

As couplers for correcting unnecessary absorption of colored dyes, are preferably used yellow colored cyan couplers of formulae (CI), (CII), (CIII) and (CIV) described in EP 456,257A1, page 5 (especially, YC-86 in page 84); yellow colored magenta couplers ExM-7 (page 202), Ex-1 (page 249) and Ex-7 (page 251) in EP 456,257A1; magenta colored cyan couplers CC-9 (column 8) and CC-13 (column 10) in U.S. Pat. No. 4,833,069; (2) (column 8) in U.S. Pat. No. 4,837,136; and colorless masking couplers of formula (A) in claim 1 of WO92/11575 (especially compounds illustrated in pages 36 to 45).

As compounds (including couplers) which release a residue of a photographically-useful compound when reacted with an oxidation product of a developing agent, are mentioned the following:

Development Inhibitor-releasing Compounds:

Compounds of formulae (I), (II), (III) and (IV) described in EP 378,236A1, page 11 (especially, T-101 in page 30, T-104 in page 31, T-113 in page 36, T-131 in page 45, T-144 in page 51, T-158 in page 58); compounds of formula (I) in EP 436,938A2, page 7 (especially, D-49 in page 51); compounds of formula (1) in Japanese Patent Application No. 4-134523 (especially, (23) in column (0027)); compounds of formulae (I), (II) and (III) in EP 440,195A2, pages 5 to 6 (especially, I-(1) in page 29).

Bleaching Accelerator-releasing Compounds: Compounds of formulae (I) and (I') in EP 310,125A2, page 5 (especially (60) and (61) in page 61); compounds of formula (I) in claim 1 of JP-A 6-59411 (especially, (7) in column (0022)).

Ligand-releasing Compounds:

Compounds of LIG-X in claim 1 of U.S. Pat. No. 4,555,478 (especially compounds in column 12, lines 21 to 41).

Leuco Dye-releasing Compounds:

Compounds 1 to 6 in U.S. Pat. No. 4,749,641, columns 3 to 8.

Fluorescent Dye-releasing Compounds:

Compounds represented by COUP-DYE in claim 1 of U.S. Pat. No. 4,774,181 (especially, Compounds 1 to 11 in columns 7 to 10).

Development Accelerator-releasing or Foggant-releasing Compounds:

Compounds of formulae (1), (2) and (3) in U.S. Pat. No. 4,656,123, column 3 (especially, (1-22) in column 25); ExZK-2 in EP 450,637A2, page 75, lines 36 to 38.

Compounds releasing a group that becomes a dye only after released:

Compounds of formula (I) in claim 1 of U.S. Pat. No. 4,857,447 (especially, Y-1 to Y-19 in columns 25 to 36).

Preferred additives other than couplers are the following:

Dispersion Media for Oil-soluble Organic Compounds:

P-3, 5, 16, 19, 25, 30, 42, 49, 54, 55, 66, 81, 85, 86 and 93 in JP-A 62-215272 (pages 140 to 144).

Latexes for Impregnation of Oil-soluble Organic Compounds:

Latexes described in U.S. Pat. No. 4,199,363.

Scavengers for Oxidation Products of Developing Agents: Compounds of formula (I) in U.S. Pat. No. 4,978,606, column, 2, lines 54 to 62 (especially, I-(1), (2), (6) and (12) in columns 4 to 5); compounds of formulae in U.S. Pat. No. 4,923,787, column 2, lines 5 to 10 (especially, Compound 1 in column 3).

Anti-staining Agents:

Compounds of formulae (I) to (III) in EP 298,321A, page 4, lines 30 to 33 (especially, 1-47 and 72, III-1 and 27 in pages 24 to 28).

Anti-fading Agents:

A-6, 7, 20, 21, 23, 24, 25, 26, 30, 37, 40, 42, 48, 63, 90, 92, 94 and 164 in EP 298,321A, pages 69 to 118; II-1 to III-23, especially III-10, in U.S. Pat. No. 5,122,444, column 25 to 38; I-1 to III-4, especially II-2, in EP 471,347A, pages 8 to 12; A-1 to 48, especially A-39 and 42, in U.S. Pat. No. 5,139,931, columns 32 to 40.

Materials for Reducing Effective Amounts of Coloring Enhancers or Color Mixing Preventing Agents:

I-1 to II-15, especially I-46, in EP 411,324A, page 5 to 24.

Formalin Scavengers:

SCV-1 to 28, especially SCV-8, in EP 477,932A, pages 24 to 29.

Hardening Agents:

H-1, 4, 6, 8 and 14 in JP-A 1-214845, page 17; compounds (H-1 to 54) of formulae (VII) to (XII) in U.S. Pat. No. 4,618,573, columns 13 to 23; compounds (H-1 to 76, especially H-14) of formula (6) in JP-A 2-214852, page 8, right bottom column; compounds stated in claim 1 in U.S. Pat. No. 3,325,287.

Development Inhibitor Precursors:

P-24, 37 and 39 in JP-A 62-168139, pages 6 to 7; compounds stated in claim 1 in U.S. Pat. No. 5,019,492, especially Compounds 28 and 29 in column 7.

Antiseptics, Antifungal Agents:

I-1 to III-43, especially II-1, 9, 10 and 18 and III-25, in U.S. Pat. No. 4,923,790.

Stabilizers, Antifoggants:

I-1 to (14), especially I-1 and 60, (2) and (13), in U.S. Pat. No. 4,923,793; Compounds 1 to 65, especially 36, in U.S. Pat. No. 4,952,483, columns 25 to 32.

Chemical Sensitizing Agents:

Triphenylphosphine selenide; Compound 50 in JP-A 5-40324.

Dyes:

In JP-A 3-156450, a-1 to b-20, especially a-1, 12, 18, 27, 35, and 36, b-5 (pages 15 to 18), and V-1 to 23, especially V-1 (pages 27 to 29); in EP 445627A, F-I-1 to F-II-43, especially F-I-11 and F-II-8 (pages 33 to 55); in EP 457153A, III-1 to 36, especially III-1 and 3, in pages 17 to 28; fine crystalline dispersions of Dye-1 to 124 in WO88/04794, pages 8 to 26; Compounds 1 to 22, especially Compound 1, in EP 319999A, pages 6 to 11; Compounds D-1 to 87 of formulae (1) to (3) in EP 519,306A, pages 3 to 28; Compounds 1 to 22 of formula (I) in U.S. Pat. No. 4,268,622, columns 3 to 10; Compounds (1) to (31) of formula (I) in U.S. Pat. No. 4,923,788, columns 2 to 9.

UV Absorbents:

Compounds (18b) to (18r) and 101 to 427 of formula (1) in JP-A 46-3335, pages 6 to 9; in EP 520,938A, Compounds (3) to (66) of formula (I) (pages 10 to 44) and Compounds HBT-1 to 10 of formula (III) (page 14); Compounds (1) to (31) of formula (1) in EP 521,823A, columns 2 to 9.

The present invention may apply to various color photographic materials, such as color negative films for general use or for movie use, color reversal films for slide use or for television use, as well as color papers color positive films and color reversal papers. In addition, it is suitable for lens-combined film units such as those described in JP-B 2-32615 (the term "JP-B" as used herein means an "examined Japanese patent publication") and examined Japanese Utility Model Publication No. 3-39784.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the surface of the support of having emulsion layers is 28 microns or less, preferably 23 microns or less, more preferably 18 microns or less, especially preferably 16 microns or less, in the photographic material of the present invention. It is also desired that the photographic material of the invention has a film swelling rate ($T_{1/2}$) of 30 seconds or less, preferably 20 seconds or less. The film swelling rate ($T_{1/2}$) is defined as follows: 90% of the maximum swollen thickness of the photographic material as processed in a color developer under the condition of 30° C. for 3 minutes and 15 seconds is referred to as a saturated swollen thickness. The time necessary for attaining a half (½) of the saturated swollen thickness is defined to be a film swelling rate ($T_{1/2}$). The film thickness as referred to herein is one as measured under controlled conditions of a temperature of 25° C. and a relative humidity of 55% (for 2 days); and the film swelling rate ($T_{1/2}$) may be measured by a swellometer of the model described in A. Green et al., *Photographic Science and Engineering*, Vol. 19, No. 2, pages 124 to 129. The film swelling rate ($T_{1/2}$) can be adjusted by adding a hardening agent to gelatin used as a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness−original film thickness)/(original film thickness).

The photographic material of the present invention may have a hydrophilic colloid layer (this is referred to as a backing layer) having a total dry thickness of from 2 μm to 20 μm on the side opposite to the side having the emulsion layers. It is preferred that the backing layer contains the above-mentioned light absorbent, filter dye, ultraviolet absorbent, antistatic agent, hardening agent, binder, plasticizer, lubricant, coating aid and surfactant. The backing layer is desired to have a swelling degree of from 150 to 500%.

The photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. As specific examples and preferred examples, are mentioned the compounds described in EP 556,700A, page 28, lines 43 to 52. These compounds can be used in combination of two or more of them, in accordance with the object.

The color developer generally contains a pH buffer such as alkali metal carbonates, borates or phosphates, and a development inhibitor or anti-foggant such as chlorides, btomides, iodides, benzimidazoles, benzothiazoles or mercapto compounds. If desired, it may also contain various preservatives such as hydroxylamine, diethylhydroxylamine, sulfites, hydrazines (e.g., N,N-biscarboxymethylhydrazine), phenylsemicarbazides, triethanolamine, catecholsulfonic acids; organic solvents such as ethylene glycol, and diethylene glycol; development accelerators such as benzyl alcohol, polyethylene glycol, quaternary ammonium salts, and amines; dye-forming couplers; competing couplers; auxiliary developing agents such as 1-phenyl-3-pyrazolidone; tackifiers; as well as various chelating agents such as aminopolycarboxylic acids, aminopolyphosphonic acids, alkylphosphonic acids, and phosphonocarboxylic acids. Examples of chelating agents include ethylenediamine-tetraacetic acid, nitrilo-triacetic acid, diethylenetriamine-pentaacetic acid, cyclohexanediaminetetraacetic acid, hydroxylethylimino-diacetic acid, 1-hydroxyethylidene- 1,1-diphosphonic acid, nitrilo-N,N,N-trimethylenephosphonic acid, ethylenediamine-N,N,N,N-tetramethylene-phosphonic acid, ethylenediamine-di(o-hydroxyphenylacetic acid) and their salts.

Where the photographic material is processed by a reversal processing, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singly or in combination of them. The color developer and the black-and-white developer generally has a pH value of from 9 to 12. The amount of the replenisher to the developer is, though depending upon the color photographic material to be processed, generally 3 liters or less per $m^2$ of the material to be processed. The effects of the present invention are remarkable when the amount of the replenisher is 600 ml or less per $m^2$ of the material. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The effect of the processing solution in the processing tank is lowered, when the solution is kept in contact with air in the tank, depending on the opening ratio which is defined by the following formula:

$$\text{Opening Ratio} = \frac{\text{(Contact Surface Area (cm}^2\text{) of Processing Solution with Air)}}{\text{(Volume (cm}^3\text{) of Processing Solution)}}$$

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A 1-82033 and employment of the slit-developing method described in JP-A 63-216050. Reduction of the opening ratio is preferably applied to not only the both steps of color development and black-and-white development but also all the subsequent steps such as bleaching, bleach-fixation, fixation, rinsing and stabilization steps. In addition, the amount of the replenisher to be added may also be reduced by means of suppressing accumulation of bromide ions in the developer. The time for color development is generally within the range of from 2 minutes to 5 minutes, but the processing time may be shortened to 60 seconds or less by elevating the processing temperature, elevating the pH value of the processing solution and/or elevating the concentration of the processing solution.

After color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of continuous two tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol etherdiamine-tetraacetic acid or with organic acids such as citric acid, tartaric acid or malic acid. Among them, aminopolycarboxylato/iron(III) complexes such as ethylenediaminetetraacetato/iron(III) complex and 1,3-diaminopropane-tetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and the prebath thereof may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, DE 1,290,812 and 2,059,988, JP-A 53-32736, 53-57831, 53-37418, 53-72623, 53-95630, 53-95631, 53-104232, 53-124424, 53-141623 and 53-28426, RD No. 17129 (July, 1978); thiazolidine derivatives as described in JP-A 50-140129; thiourea derivatives as described in JP-B 45-8506, JP-A 52-20832 and 53-32735 and U.S. Pat. No. 3,706,561; iodide salts as described in DE 1,127,715 and JP-A 58-16235; polyoxyethylene compounds as described in DE 966,410 and 2,748,430; polyamine compounds as described in JP-B 45-8836; other compounds as described in JP-A 49-40943, 49-59644, 53-94927, 54-35727, 55-26506 and 58-163940; and bromide ions. Above all, mercapto group- or disulfide group-containing compounds, in particular, those as described in U.S. Pat. No. 3,893,858, DE 1,290,812 and JP-A 53-95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the invention, usable are thiosulfates, thiocyanates, thioether compounds, thioureas, and a large amount of iodide salts. Use of thiosulfates is general for the purpose. Above all, ammonium thiosulfate is most widely used. Additionally, combination of thiosulfates and thiocyanates, thioether compounds or thioureas is also preferred. As the preservative to be used in the fixing solution or bleach-fixing solution, preferred are sulfites, bisulfites and carbonyl-bisulfite adduts, as well as sulfinic acid compounds as described in EP 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material of the present invention contains compounds having a pKa value of from 6.0 to 9.0, for the purpose of adjusting the pH value of the solution. As such compounds, preferably added are imidazoles such as imidazole, 1-methylimidazole, 1-ethylimidazole or 2-methylimidazole, in an amount of from 0.1 to 10 mol/liter.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process is promoted as much as possible. Examples of reinforced stirring means include a method of running a jet stream of the processing solution to the emulsion-coated surface of the material, as described in JP-A 62-183460; a method of promoting the stirring effect by the use of a rotating means, as described in JP-A 62-183461; a method of moving the photographic material in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote application of the bleaching agent and fixing agent into the emulsion layer of the photographic material and, as a result, the desilvering rate would be elevated. The above-mentioned reinforced stirring means is more effective, when a bleaching accelerator is incorporated into the processing solution. Because of the means, therefore, the bleaching accelerating effect could remarkably be augmented, and the fixation preventing effect by the bleaching accelerator could be evaded.

The photographic material of the present invention can be processed with an automatic developing machine. It is desired that the automatic developing machine is equipped with a photographic material-conveying means as described in JP-A 60-191257, 60-191258 and 60-191259. As is noted from the related disclosure of JP-A 60-191257, the conveying means may noticeably reduce the carry-over amount from the previous bath to the subsequent bath and therefore it is extremely effective for preventing deterioration of the processing solution. Because of the reasons, the conveying means is especially effective for shortening the processing time in each processing step and for reducing the amount of the replenisher to each processing bath.

The photographic material of the present invention is generally rinsed in water and/or stabilized, after being desilvered. The amount of the water to be used in the rinsing step can be set in a broad range, in accordance with the characteristic of the photographic material (for example, depending upon the raw material components, such as the coupler and so on) or the use of the material, as well as the temperature of the rinsing water, the number of the rinsing tanks (the number of the rinsing stages), the replenishment system of normal current or countercurrent and other vaious kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers*, Vol. 64, pages 248 to 253 (May, 1955). According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. To overcome this problem, the method of reducing calcium and magnesium ions, which is described in JP-A 62-288838, can extremely effectively be used. In addition, isothiazolone compounds and thiabendazoles described in JP-A 57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms*, edited by Association of Sanitary Technique, Japan (1982, by Kogyo Gijutsu-kai, Japan), and *Encyclopeadia of Bactericidal and Fungicidal Agents*, edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A 57-8543, 58-14834 and 60-220345, can be employed.

In addition, the material can also be stabilized, following the rinsing step. As one example of the case, there may be mentioned a stabilizing bath containing a dye stabilizer and a surfactant, which is used as a final bath for picture-taking color photographic materials. Examples of the dye stabilizers include aldehydes such as formalin and glutaraldehyde, N-methylol compounds, hexamethylenetetramine and aldehyde-sulfite adducts. The stabilizing bath may also contain various chelating agents and fungicides.

The overflow of the finsing and/or stabilizing solutions caused by addition of replenishers thereto may be reused in the other steps such as a desilvering step.

where the photographic material is processed with an automatic developing machine system and the processing solution in the step are evaporated and thickened, it is desired to add water to the solutions so as to compensate the concentration of the solutions.

The photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A 53-135628, as the precursors.

The photographic material of the present invention can contain various kinds of 1-phenyl-3-pyrazolidones, if desired, for the purpose of accelerating the color developability thereof. Specific examples of these compounds are described in JP-A 56-64339, 57-144547 and 58-115438.

The processing solutions to be used for processing the photographic material of the invention are used at 10° C. to 50° C. In general, a processing temperature of from 33° C. to 38° C. is standard, but the temperature may be made higher than 38° C. so as to accelerate the processing or to shorten the processing time, or on the contrary, the temperature may be made lower than 33° C. so as to improve the quality of images formed and to improve the stability of the processing solution.

The following examples are intended to illustrate the present invention but not to limite it in any way.

EXAMPLE 1

A multilayer color photographic light-sensitive material, sample 101, was prepared by multicoating the layers each having the following composition on a cellulose triacetate film having a subbing layer.

Light-sensitive Layer Composition

The main compounds used for each layer are classified as follows.

Exc: Cyan Coupler

ExM: Magenta Coupler

ExY: Yellow Coupler

ExS: Sensitizing Dye

UV: Ultraviolet Absorbent

HBS: Hogh-boling Organic Solvent

H: Gelatin Hardening Agent

The numeral correspnding to each component is a coated amount shown by a g/m$^2$ unit and the numeral for the silver halide is shown by the coated amount converted as silver. In this case, however, the numeral for a sensitizing dye is the coated amount shown by a mole unit to mole of the silver halide in the same layer.

| (Sample 101) | |
|---|---|
| 1st Layer (Antihalation Layer) | |
| Black Colloid Silver (Ag) | 0.18 |
| Gelatin | 1.40 |
| ExM-1 | 0.11 |
| ExF-1 | $3.4 \times 10^{-3}$ |
| HBS-1 | 0.16 |
| 2nd Layer (Interlayer) | |
| ExC-2 | 0.030 |
| UV-1 | 0.020 |
| UV-2 | 0.020 |
| UV-3 | 0.060 |
| HBS-1 | 0.05 |
| HBS-2 | 0.020 |
| Polyethyl Acrylate Latex | 0.080(solid) |
| Gelatin | 0.90 |
| 3rd Layer (Low-Sensitive Red-Sensitive Emulsion Layer) | |
| Emulsion A (Ag) | 0.23 |
| Emulsion B (Ag) | 0.23 |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.050 |
| ExC-3 | 0.030 |
| ExC-4 | 0.14 |
| ExC-5 | $3.0 \times 10^{-3}$ |
| ExC-7 | $1.0 \times 10^{-3}$ |
| ExC-8 | 0.010 |
| Cpd-2 | 0.005 |
| HBS-1 | 0.10 |
| Gelatin | 0.90 |
| 4th Layer (Intermediate-Sensitive Red-Sensitive Emulsion Layer) | |
| Emulsion C (Ag) | 0.70 |
| ExS-1 | $3.4 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.050 |
| ExC-5 | 0.010 |
| ExC-8 | 0.010 |
| Cpd-2 | 0.023 |
| HBS-1 | 0.11 |
| Gelatin | 0.60 |
| 5th Layer (High-Sensitive Red-Sensitive Emulsion Laye) | |
| Emulsion D (Ag) | 1.62 |
| ExS-1 | $2.4 \times 10^{-4}$ |
| ExS-2 | $1.0 \times 10^{-5}$ |
| ExS-3 | $3.0 \times 10^{-4}$ |
| ExC-1 | 0.10 |
| ExC-3 | 0.050 |
| ExC-5 | $2.0 \times 10^{-3}$ |
| ExC-6 | 0.010 |
| ExC-8 | 0.010 |
| Cpd-2 | 0.025 |
| HBS-1 | 0.20 |
| HBS-2 | 0.10 |
| Gelatin | 1.30 |
| 6th Layer (Intermediate Layer) | |
| Cpd-1 | 0.090 |
| HBS-1 | 0.05 |
| Polyethylene Acrylate Latex | 0.15(solid) |
| Gelatin | 1.10 |
| 7th Layer (Low-Sensitive Green-Sensitive Emulsion Layer) | |
| Emulsion E (Ag) | 0.24 |
| Emulsion F (Ag) | 0.24 |
| ExS-4 | $4.0 \times 10^{-5}$ |
| ExS-5 | $1.8 \times 10^{-4}$ |
| ExS-6 | $6.5 \times 10^{-4}$ |

-continued

| (Sample 101) | |
|---|---|
| ExM-1 | $5.0 \times 10^{-3}$ |
| ExM-2 | 0.28 |
| ExM-3 | 0.086 |
| ExM-4 | 0.030 |
| ExY-1 | 0.015 |
| HBS-1 | 0.30 |
| HBS-3 | 0.010 |
| Gelatin | 0.85 |
| 8th Layer (Intermediate-sensitive Green-Sensitive Emulsion Layer) | |
| Emulsion G (Ag) | 0.94 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.14 |
| ExM-3 | 0.045 |
| EXM-5 | 0.020 |
| ExY-1 | $7.0 \times 10^{-3}$ |
| ExY-4 | $2.0 \times 10^{-3}$ |
| ExY-5 | 0.020 |
| HBS-1 | 0.16 |
| HBS-3 | $8.0 \times 10^{-3}$ |
| Gelatin | 0.80 |
| 9th Layer (High-Sensitive Green-Sensitive Emulsion Layer) | |
| Emulsion H (Ag) | 1.29 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| EXM-4 | 0.050 |
| EXM-5 | 0.020 |
| ExY-4 | $5.0 \times 10^{-3}$ |
| Cpd-3 | 0.050 |
| HBS-1 | 0.20 |
| HBS-2 | 0.08 |
| Polyethyl Acrylate Latex | 0.26(solid) |
| Gelatin | 1.45 |
| 10th Layer (Yellow Filter Layer) | |
| Yellow Colloid Silver (Ag) | $7.5 \times 10^{-3}$ |
| Cpd-1 | 0.13 |
| Cpd-4 | $7.5 \times 10^{-3}$ |
| HBS-1 | 0.60 |
| Gelatin | 0.60 |
| 11th Layer (Low-Sensitive Blue-Sensitive Emulsion Layer) | |
| Emulsion I (Ag) | 0.25 |
| Emulsion J (Ag) | 0.25 |
| Emulsion K (Ag) | 0.10 |
| ExS-7 | $8.0 \times 10^{-4}$ |

-continued

| (Sample 101) | |
|---|---|
| ExC-7 | 0.010 |
| ExY-1 | $5.0 \times 10^{-3}$ |
| ExY-2 | 0.40 |
| ExY-3 | 0.45 |
| ExY-4 | $6.0 \times 10^{-3}$ |
| ExY-6 | 0.10 |
| HBS-1 | 0.30 |
| Gelatin | 1.65 |
| 12th Layer (High-Sensitive Blue-Sensitive Emulsion Layer) | |
| Emulsion L (Ag) | 1.30 |
| ExS-7 | $3.0 \times 10^{-4}$ |
| ExY-2 | 0.15 |
| ExY-3 | 0.06 |
| ExY-4 | $5.0 \times 10^{-3}$ |
| Cpd-2 | 0.10 |
| HBS-1 | 0.070 |
| Gelatin | 1.20 |
| 13th Layer (1st Protective Layer) | |
| UV-2 | 0.10 |
| UV-3 | 0.12 |
| UV-4 | 0.30 |
| HBS-1 | 0.10 |
| Gelatin | 2.50 |
| 14th Layer (2nd Protective Layer) | |
| Emulsion M (Ag) | 0.10 |
| H-1 | 0.37 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.70 |

Furthermore, each layer suitably contained one or more of W-1 to W-3, B-4 to B-6, F-1 to F-17, an iron salt, a lead salt, a gold salt, a platinum salt, an iridium salt, a palladium salt, and a rhodium salt for improving the storage stability, the process property, the pressure durability, a antifungal-antibacterial property, the antistatic property, the coating property.

In addition, in the case of incorporating Cpd-4 in 10th Layer (yellow filter layer), the compound was dispersed in a solid form according to the method described in PCT Patent Publication (unexamined) No. 88/4794.

The emulsions A to M used for preparing the sample 101 described above were AgBrI emulsion and are shown in Table 1 below in detail.

TABLE 1

| Emulsion | Grain Form (Halogen Structure) | Average AGI content (%) | Intergrain iodine distribution variation coefficient (%) | Mean grain size (sphere-equivalent (μm) | Coefficient of variation relative to grain sizes (%) | Ratio of diameter/thickness |
|---|---|---|---|---|---|---|
| A | Circular Tabular (uniform Structure) | 0 | — | 0.45 | 15 | 5.5 |
| B | Cubic (Shell high-iodine, double struct.) | 1.0 | — | 0.20 | 8 | 1 |
| C | Tetradecahedral (intermediate high-iodine triple struct.) | 4.5 | 25 | 0.85 | 18 | 1 |
| D | Hexagonal Tabular (outer side high iodine structure) | 2.0 | 16 | 1.10 | 17 | 7.5 |
| E | Circular Tabular (outer side high iodine structure) | 1.0 | — | 0.45 | 15 | 3.0 |

TABLE 1-continued

| Emulsion | Grain Form (Halogen Structure) | Average AGI content (%) | Intergrain iodine distribution variation coefficient (%) | Mean grain size (sphere-equivalent (μm) | Coefficient of variation relative to grain sizes (%) | Ratio of diameter/ thickness |
|---|---|---|---|---|---|---|
| F | Octahedral (core high iodine double struct.) | 6.0 | 22 | 0.25 | 8 | 1 |
| G | Tetradecahedral (intermediate high iodine triple struct.) | 4.5 | 19 | 0.85 | 19 | 1 |
| H | Hexagonal Tabular (outer side high-iodine structure) | 3.5 | 16 | 1.10 | 16 | 6.8 |
| I | Circular Tabular (center portion high-iodine structure) | 2.0 | 15 | 0.45 | 15 | 6.0 |
| J | Cubic (uniform structure) | 1.0 | 10 | 0.30 | 8 | 1 |
| K | Tetradecahedral (core high-iodine triple structure) | 18.0 | 8 | 0.80 | 18 | 1 |
| L | Hexagonal Tabular (intermediate high-iodine structure) | 12.0 | 12 | 1.35 | 22 | 12.0 |
| M | Light-insensitive fine particles (uniform structure) | 1.0 | — | 0.04 | 15 | 1 |

In Table 1;
(1) Each of the emulsions I to L was reduction sensitized at the preparation of the silver halide grains using thiourea dioxide and thiosulfonic acid according to the Example in JP-A-2-191938 (corresponding to U.S. Pat. No. 5,061,614).
(2) Each of the emulsions A to L was subjected to a gold sensitization, a sulfur sensitization, and a selenium sensitization in the presence of the spectral sensitizing dyes added into each light-sensitive silver halide emulsion layer and sodium thiocyanate according to the Example in JP-A-3-237450 (corresponding to EP 443,453A).
(3) At the preparation of the tabular silver halide grains, a low-molecular weight gelatin was used according to the Example in JP-A-1-158426.
(4) In the tabular silver halide grains, the transition lines as described in JP-A-3-237450 were observed using a high-voltage electromicroscope.

In addition, in the case of preparing the sample described above, the couplers and the additives for each layer were dispersed in an aqueous gelatin solution by the method shown in Table 2 below and the addition method for each layer is shown in Table 3 below.

TABLE 2

| Dispersion Method | Method |
|---|---|
| A | Method of neutralizing a homogeneous aqueous solution of the couplers, the high-boiling organic solvents, the surface active agent, sodium hydroxide, n-propanol, and other additives to deposite and disperse these additives. |
| B | Method of adding a homogeneous n-propanol solution of the couplers, the high-boiling organic solvents, and other additives to an aqueous solution of the suface active agent to deposite and disperse these additives. |
| C | Method of mixing a solution of the couplers, the high-boiling organic solvents, the surface active agent, a low-boiling organic solvent, and other additives with an aqueous solution of gelatin and the surface active agent followed by stirring and dispersing by emulsification, and removing the low-boiling organic solvent by distillation. |
| D | Method of removing the organic solvents from the mixture by water washing or a ultrafiltration after dispersing in the method C. |

TABLE 3

| Layer | Dispersing Method- | Mean Dispersed Grain Size [nm] |
|---|---|---|
| Layer 3 | C | 133 |
| Layer 4 | C | 130 |
| Layer 5 | D | 40 |
| Layer 7 | C | 135 |
| Layer 8 | C | 60 |
| Layer 9 | A | 40 |
| Layer 11 | C | 125 |
| Layer 12 | B | 80 |

Then, the compounds used for preparing the Sample 101 described above are shown below.

ExC-1
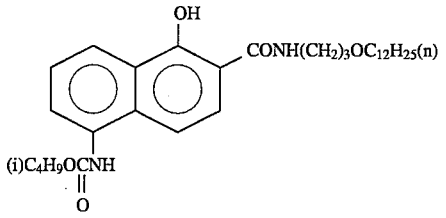
ExC-2
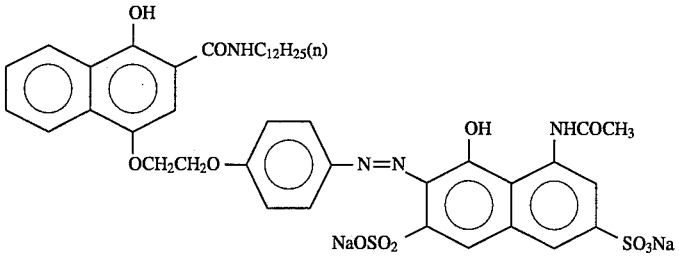
ExC-3
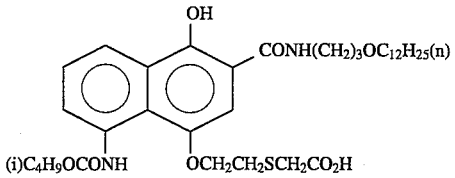
ExC-4
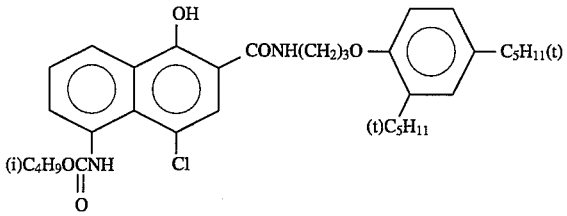
ExC-5
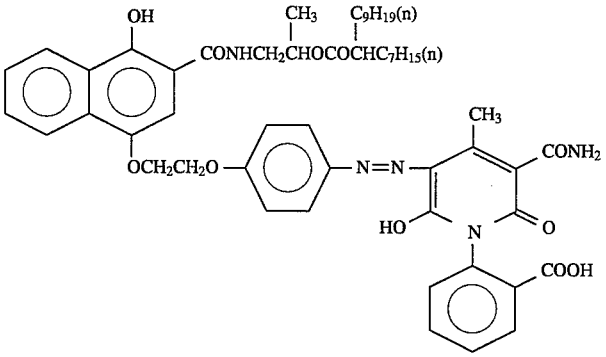
ExC-6
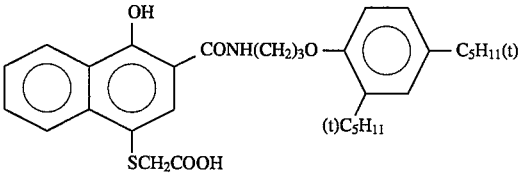

-continued
ExC-7
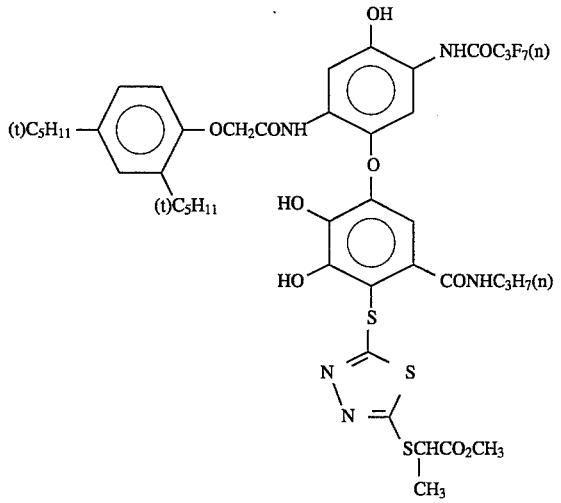
ExC-8
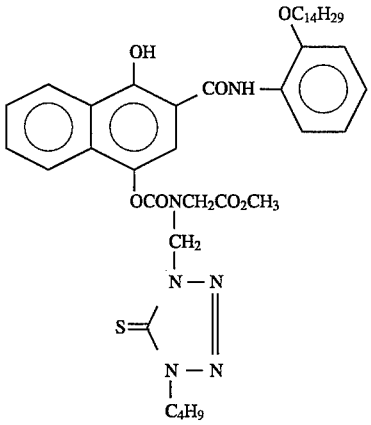
ExM-1
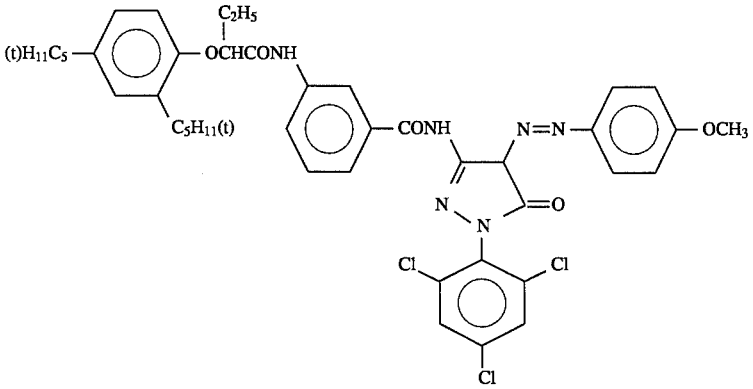
ExM-2
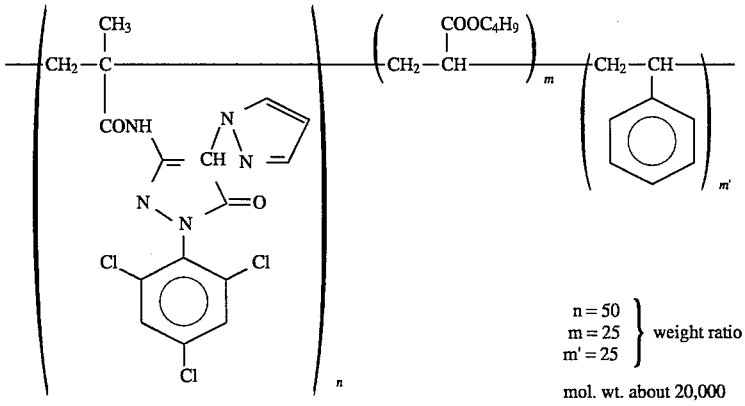

-continued
ExM-3
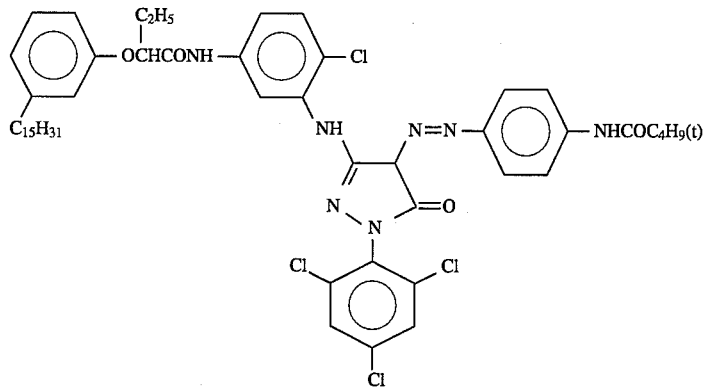
ExM-4
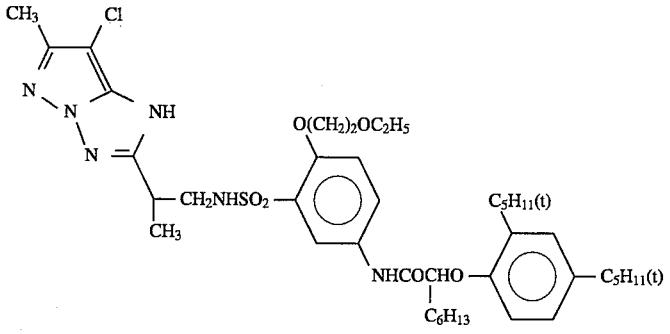
ExM-5
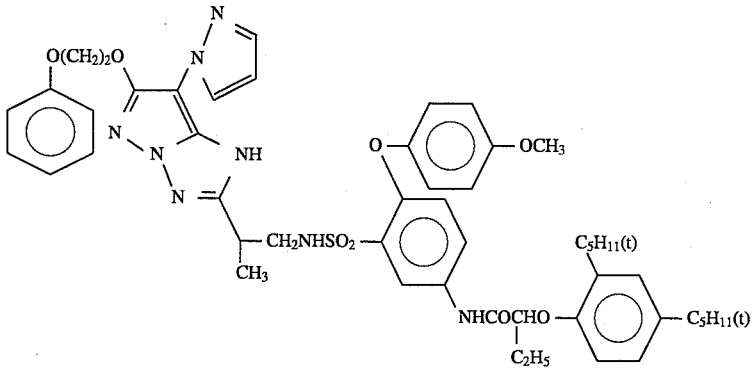
ExY-1
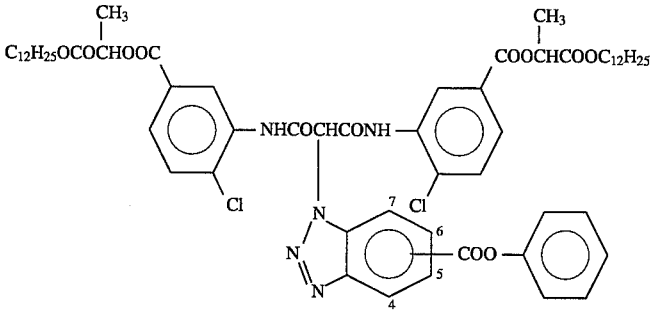
(a mixture of compounds substituted at the 5- or 6- position)

-continued
ExY-2
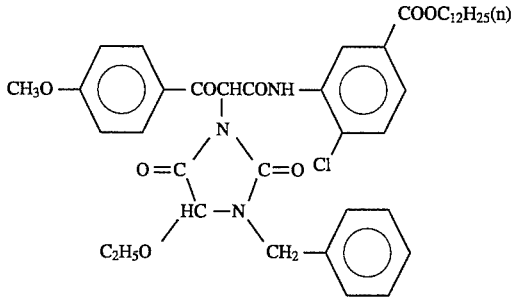
ExY-3
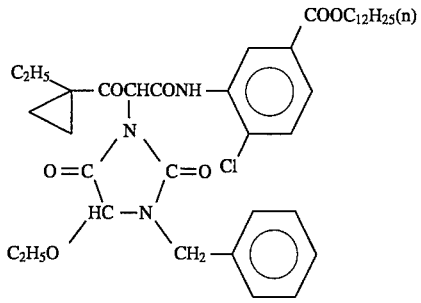
ExY-4
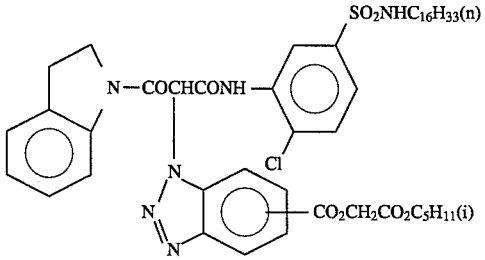
ExY-5
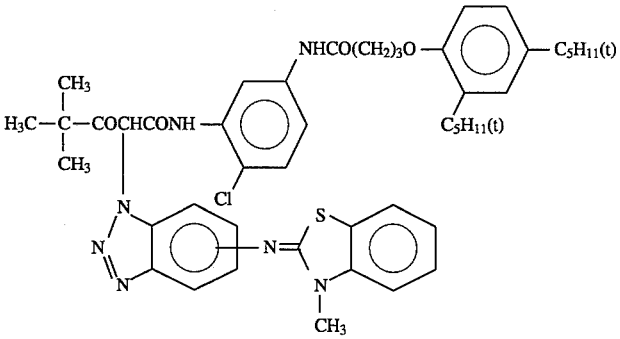
ExY-6
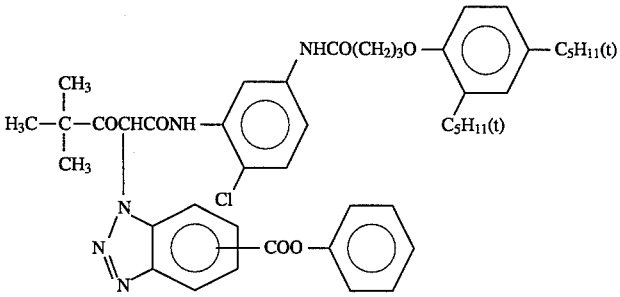
ExF-1
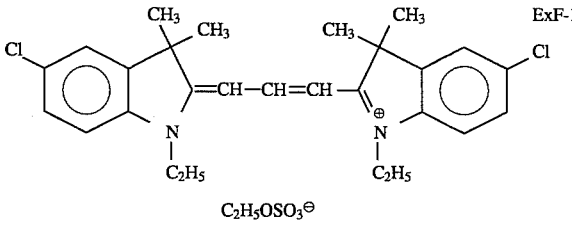
Cpd-1
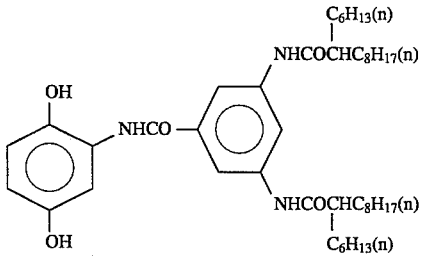
Cpd-2
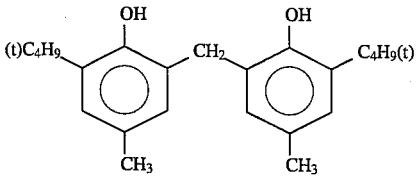
Cpd-3
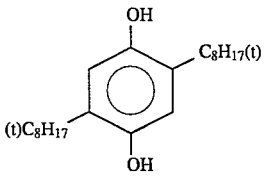

-continued
Cpd-4
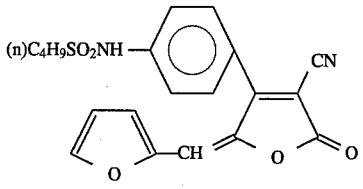
UV-1
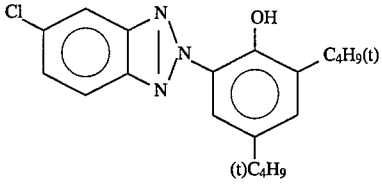
UV-2
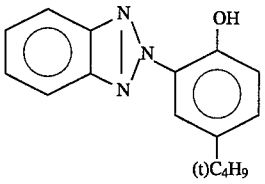
UV-3
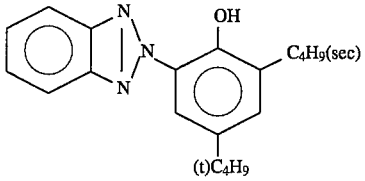
UV-4
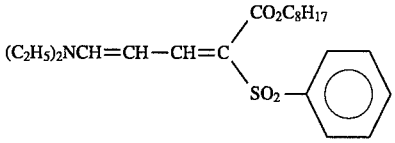
Tricresylphosphate HBS-1
Di-n-butylphthalate HBS-2
HBS-3
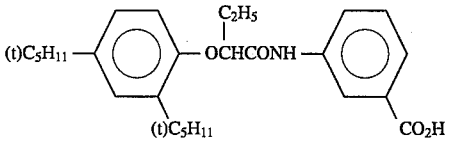
ExS-1
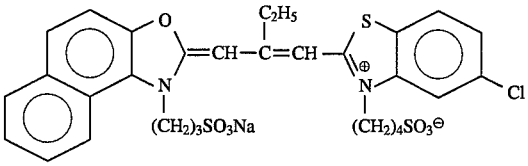
ExS-2
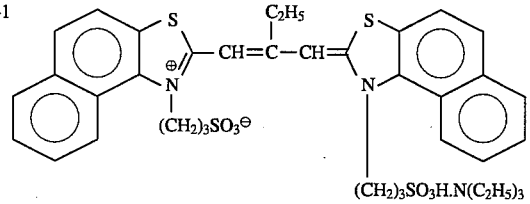
ExS-3
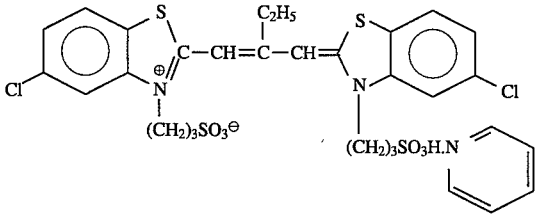
ExS-4
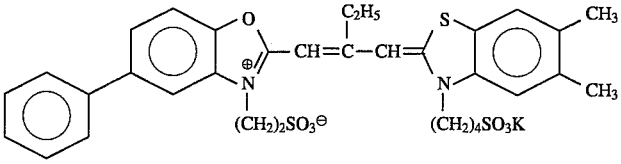
ExS-5
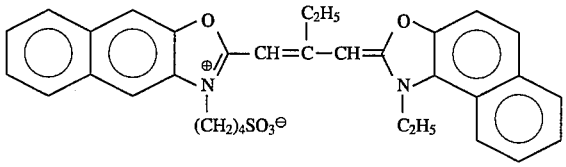
ExS-6
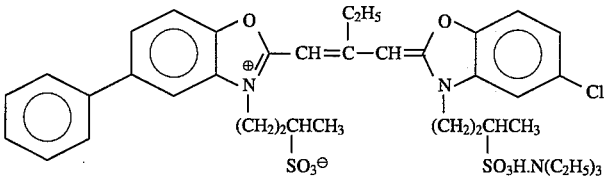

-continued
ExS-7
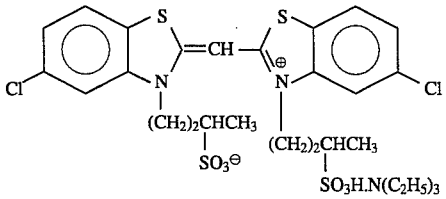
H-1
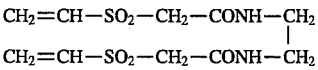
B-2
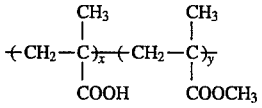
x/y = 40/60 (by weight)
B-4
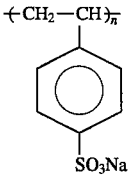
B-6
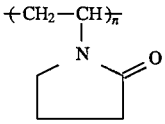
(mol. wt. about 10,000)
W-2
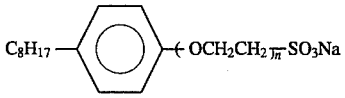
n = 2~4 (a mixuture of n = 2~4)
F-1
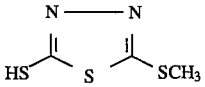
F-3
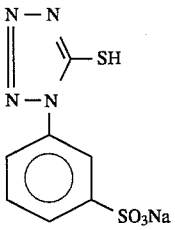
F-5
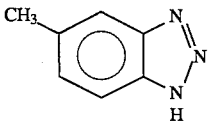
S-1
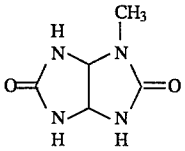
B-1
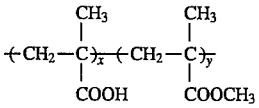
x/y = 10/90 (by weight)
B-3
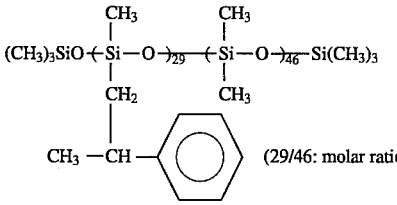
(29/46: molar ratio)
B-5
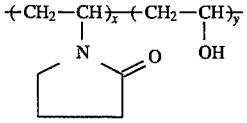
x/y = 70/30 (by weight)
W-1
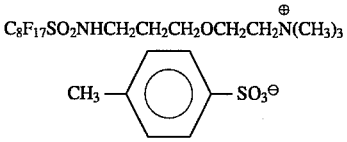
W-3
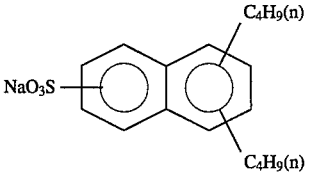
(a mixture)
F-2
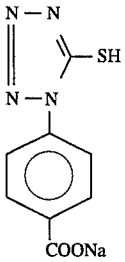
F-4
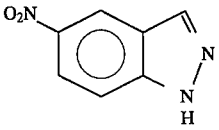
F-6
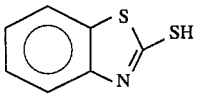

-continued

F-7

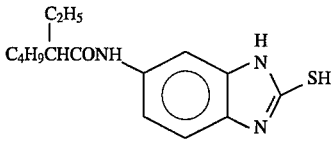

F-8

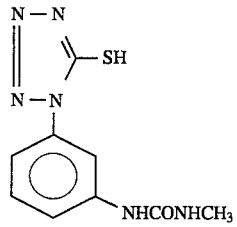

F-9

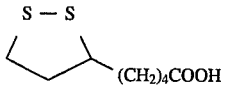

F-10

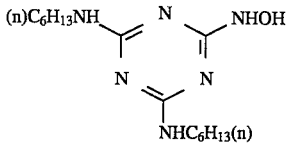

F-11

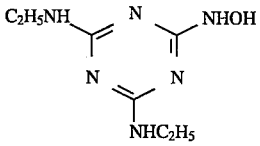

F-12

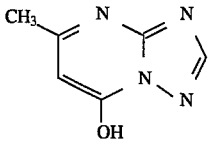

F-13

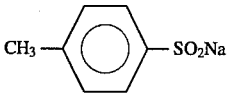

F-14

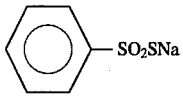

F-15

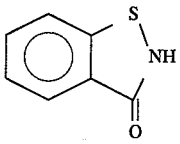

F-16

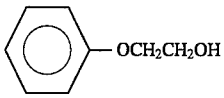

F-17

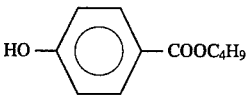

Comparative Compound
(disclosed in JP-A-51-26038)

B-1

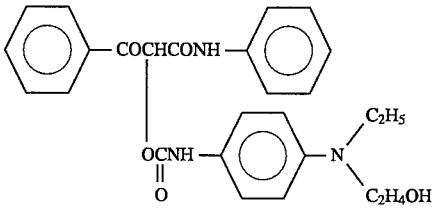

Comparative Compound
(disclosed in JP-A-61-156126)

B-2

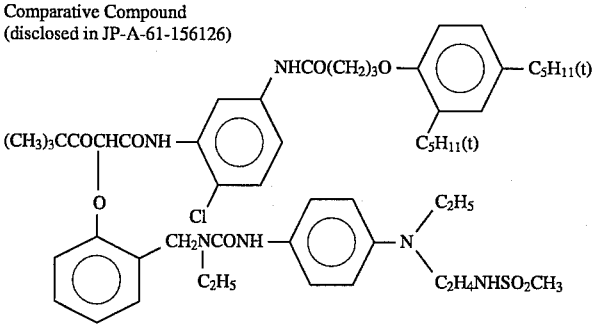

By following the same procedure as the preparation of the Sample 101, except that an equimolar amount of each of the compounds shown in Table 4 below was used in place of the compounds ExY-2 and ExY-3 used in the 11th layer, each of Samples 102 to 107 was prepared.

Each of the Samples 101 to 107 was subjected to a sensitometric exposure according to an ordinary manner under the conditions of a color temperature of 4800° K., 5 CMS, and 1/100 second, processed by the processing conditions shown in the Processing Method 1 shown below, then, the photographic characteristics were evaluated, and the results shown in Table 4 below were obtained.

Processing Method 1
Processing Steps

| Step | Processing Time | Processing Temperatur | Replenising Amount (ml) | Tank Volume (liter) |
|---|---|---|---|---|
| Color Development | 3 min. 15 sec. | 38° C. | 45 | 10 |
| Bleach | 30 sec. | 38° C. | 20 | 4 |
| | | | All of the overflow amount of the bleach | |

-continued

Processing Method 1
Processing Steps

| Step | Processing Time | Processing Temperatur | Replenising Amount (ml) | Tank Volume (liter) |
|---|---|---|---|---|
| | | | liquid was introduced into the blix tank | |
| Blix | 2 min. 30 sec. | 38° C. | 30 | 8 |
| Wash (1) | 40 sec. | 35° C. | Counter-current system from (2) to (1) | 4 |
| Wash (2) | 60 sec. | 38° C. | 30 | 4 |
| Stabiliza-tion | 45 sec. | 38° C. | 20 | 4 |
| Drying | 1 min. 15 sec. | 55° C. | | |

(*): The replenishing amount was per 35 mm × 1.1 meters (corresponding to one 24-exposure roll film).

Then, the compositions of the processing liquids are shown below.

| Color Developer | Tank liquid (g) | Replenisher (g) |
|---|---|---|
| Diethylenetriaminepentaacetic Acid | 1.0 | 1.1 |
| 1-Hydroxyethylidene-1,1-diphosphonic Acid | 2.0 | 2.0 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-(β-hydroxyethyl)-amino]-2-methylaniline sulfate | 4.5 | 5.5 |
| Water to make | 1 liter | 1 liter |
| pH (adjusted with KOH and $H_2SO_4$) | 10.05 | 10.10 |

| Bleach Liquid (Tank liquid = Replenisher) | |
|---|---|
| Ethylenedaiminetetraacetic Acid Ferric Ammonium Dehydrate | 120.0 g |
| Ethylenediaminetetraacetic Acid Disodium Salt | 10.0 g |
| Ammonium Bromide | 100.0 g |
| Amonium Nitrate | 10.0 g |
| Bleach Accelerator $(CH_3)_2N—CH_2CH_2S—S—CH_2CH_2—N(CH_3)_2.2HCl$ | 0.005 mole |
| Aqeous Ammonia (27%) | 15.0 ml |
| Water to make | 1.0 liter |
| pH (adjusted with aqueous ammonia and $HNO_3$) | 6.3 |

| Blix Liguid | Tank | Replenisher Liquid |
|---|---|---|
| Ethylenediaminetetraacetic Acid Ferric Ammonium Dehydrate | 50.0 g | — |
| Ethylenediaminetetraacetic Acid Disodium Salt | 5.0 g | 2.0 g |
| Sodium Sulfite | 12.0 g | 20.0 g |
| Aqueous Anunonium Thiosulfate Solution (700 g/liter) | 240.0 ml | 400.0 ml |
| Aqueous Ammonia (27%) | 6.0 ml | — |
| Water to make | 1.0 liter | 1.0 liter |
| pH (adjusted with aqueous ammonia and $CH_3COOH$) | 7.2 | 7.3 |

Wash Water (Tank Liquid = Replenisher)

City water was passed through a mixed bed column packed with a H-type strong acidic cation exchange resin (Amberlite 1R-120B, trads name, made by Rohm and Haas Company) and an OH-type strong basic anion exchange resin (Amberlite IR-400, trade name, made by Rohm and Haas Company) to reduce calcium and magnesium ion concentrations below 3 mg/liter and then 20 mg/liter of sodium dichloroisocyanurate and 0.15 g/liter of sodium sulfate were added thereto.The pH thereof was in the range of from 6.5 to 7.5.

-continued

| Stabilization Liquid (Tank Liquid = Replenisher) | |
|---|---|
| Sodium p-toluensulfinate | 0.03 g |
| Polyoxyethylene-p-monononylphenyl ether (average molecular degree 10) | 0.2 g |
| Ethylenediaminetetraacetic Acid Disodium Salt | 0.05 g |
| 1,2,4-Trizole | 1.3 g |
| 1,4-Bis(1,2,4-triazol-1-ylmethyl)piperazine | 0.75 g |
| Water to make | 1.0 liter |
| pH | 8.5 g |

In Table 4, the color density of BL means the color density of the blue-sensitive emulsion layer at the exposure amount corresponding to the exposure amount 100 CMS.

TABLE 4

| Sample No. | Compound Used for 11th Layer | BL Dmin | BL Color Density | Remarks |
|---|---|---|---|---|
| 101 | ExY-2, ExY-3 | 0.93 | 1.82 | Comparative |
| 102 | Comparative compound (B-1) | 0.94 | 1.52 | Comparative |
| 103 | Comparative compound (B-2) | 0.93 | 1.72 | Comparative |
| 104 | Compound (9) | 0.92 | 2.02 | Invention |
| 105 | Compound (10) | 0.93 | 2.10 | Invention |
| 106 | Compound (11) | 0.93 | 2.21 | Invention |
| 107 | Compound (12) | 0.93 | 2.24 | Invention |

From the results shown in Table 4, it can be seen that by using the compounds of the present invention, the color density of the blue-sensitive emulsion layers is increased, whereby the effect of the present invention is confirmed. Also, since in the comparative examples and the examples of this invention, there is almost no difference in the changes of BL Dmin (minimum densities of the blue-sensitive emulsion layers), it can be seen that the effect of the present invention acts imagewise.

EXAMPLE 2

Each of the Samples 101 to 107 as perpared in Example 1 was processed under the processing condtions of Processing Method 2 shown below, the same evaluations as in Example 1 were carried out, and the results are shown in Table 5 below.

Processing Method 2

| Processing Step | Temperature | Time |
|---|---|---|
| Color Development | 45° C. | 60 sec. |
| Blix | 45° C. | 60 sec. |
| Wash (1) | 40° C. | 15 sec. |
| Wash (2) | 40° C. | 15 sec. |
| Wash (3) | 40° C. | 15 sec. |
| Stabilization | 40° C. | 15 sec. |
| Drying | 80° C. | 60 sec. |

For wash step, a 3 tank countercurrent system of from (3) to (1) was employed.

The composition for the each processing liquid was as follows.

| Color Developer | |
|---|---|
| Diethylenetriaminepentaacetic Acid | 1.0 g |
| 1-Hydroxyethylidene-1,1-diphosphonic Acid | 2.0 g |

-continued

| | |
|---|---|
| Sodium Sulfite | 4.0 g |
| Potassium Carbonate | 40.0 g |
| Potassium Bromide | 1.4 g |
| Potassium Iodide | 1.5 mg |
| Hydroxylamine Sulfate | 2.4 g |
| 4-[N-Ethyl-N-(β-hydroxyethyl)amino]-2-methylaniline Sulfate | 7.0 g |
| Water to make | 1.0 liter |
| pH (adjusted with potassium hydroxide and sulfuric acid) | 10.05 |
| Blix Liquid | |
| Chelating Agent ({N,N,N'-tris(carboxymethyl)-N-(2-carboxyphenyl)}ethylenediamine) | 0.17 mole |
| Ferric Nitrate $9H_2O$ | 0.15 mole |
| Ammonium Thiosulfate | 1.25 moles |
| Ammonium Sulfite | 0.10 mole |
| Metacarboxybenzenesulfinic Acid | 0.05 mole |
| Water to make | 1.0 liter |
| pH (adjusted with acetic acid and ammonia) | 5.8 |
| Wash Water | |
| Wash water having the same composition as that of wash water described in Example 1 was used. | |
| Stabilization Liquid | |
| The liquid having the same composition as that of the stabilization liquid described in Example 1 was used. | |

TABLE 5

| Sample No. | Compound Used for 11th Layer | BL Dmin | BL Color Density | Remarks |
|---|---|---|---|---|
| 101 | ExY-2, ExY-3 | 0.92 | 1.65 | Comparative |
| 102 | Comparative compound (B-1) | 0.93 | 1.50 | Comparative |
| 103 | Comparative compound (B-2) | 0.93 | 1.65 | Comparative |
| 104 | Compound (9) | 0.92 | 2.00 | Invention |
| 105 | Compound (10) | 0.93 | 2.06 | Invention |
| 106 | Compound (11) | 0.92 | 2.18 | Invention |
| 107 | Compound (12) | 0.92 | 2.22 | Invention |

From the results shown in Table 5, the effect of the present invention is remarkable. Also, from the comparison of the results shown in Table 5 with the results shown in Table 4, the effect of the present invention in the processing method of a short processing time is remarkable. This is assumed to be that in processing of a short time, the diffusion of the color developing agent becomes the rate-determining step of the development rate.

EXAMPLE 3

Each of the Samples 101 to 107 described above was processed by the processing method described in JP-A-4-274425 (corresponding to U.S. Pat. No. 5,296,339), whereby the continuous processing property thereof was tested. In this case, however, the processing time for the color development was 2 minutes and 30 seconds. As the result of testing by changing the replenishing amount (1200 ml to 300 ml) as described in Table 1-2 described in foregoing JP-A-4-274425, it was clear that in the samples of the present invention, lowering of the color density was less and low replenishing processing could be employed.

EXAMPLE 4

The sample 103 described in Example 1 of JP-A-4-145433 (corresponding to U.S. Pat. No. 5,264,332) and Sample 401 prepared by using the equimolar amount of the Compound (14) of the present invention in place of ExY used for the 1st Layer of the Sample 103 were prepared. Each of the samples was exposed and processed as described above in Example 1 of JP-A-4-145433. In this case, however, the development process was carried out by changing the processing time of the color development to 35 seconds. The results showed that the Sample 401 of the present invention showed less lowering of the color density as compared with the Comparative Sample 103 and was excellent.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having on a support at least one light-sensitive silver halide emulsion layer, wherein the color photographic material contains a nondiffusing coupler represented by formula (I):

$$Cp—(LINK)_n—N(R_1)—Ar(OR_2)—X \quad (I)$$

wherein Cp represents a coupler residue (residual group) which can undergo coupling reaction with the oxidation product of a color developing agent to release—$(LINK)_n$—$N(R_1)$—$Ar(OR_2)$—X; LINK represents a group which can release —$N(R_1)$—$Ar(OR_2)$—X after cleavage of bond to Cp; n represents 0 or an integar of 1 or 2, Ar represents an arylene group; X represents an amino group, an alkoxy group or a hydroxyl group; $R_1$ represents a hydrogen atom or a substituent $R_2$ represents an alkyl group or an aryl group; and X and N are located para relative to each other.

2. The silver halide color photographic material as claimed in claim 1, wherein Cp represents a yellow image-forming coupler residue, a magenta image-forming coupler residue, or a cyan image-forming coupler residue.

3. The silver halide color photographic material as claimed in claim 1, wherein Cp is a coupler residue selected from the group consisting of pivaloylacetanilide coupler residues, benzoylacetanilide coupler residues, malondiester coupler residues, malondiamide coupler residues, dibenzoylmethane coupler residues, bensothiazolylacetamide coupler residues, malonestermonoamide coupler residues, triazolylacetamide coupler residues, benzimidazolylacetamide coupler residues, cycloalkanoylaetamide coupler residues, 5-pyrazolone coupler residues, pyrazolobenzimidazole coupler residues, pyrazolotriazole coupler residues, pyrazoloimidazole coupler residues, cyanoacetophenone coupler residues, phenol coupler residues, and naphthol coupler residues.

4. The silver halide color photographic material as claimed in claim 1, wherein Cp is a coupler residue selected from the group consisting of

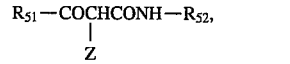

(Cp-1)

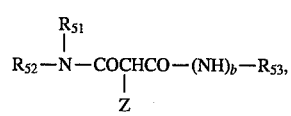

(Cp-2)

-continued (Cp-3)

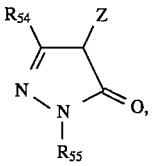

(Cp-4)

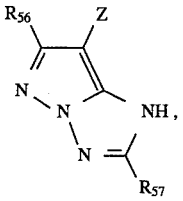

(Cp-5)

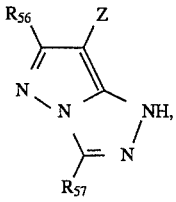

(Cp-6)

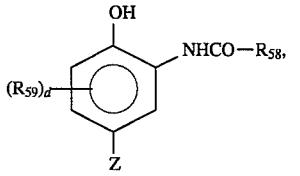

(Cp-7)

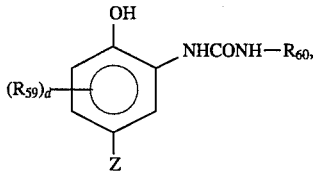

(Cp-8)

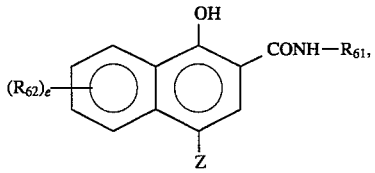

(Cp-9)

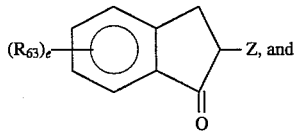

(Cp-10)

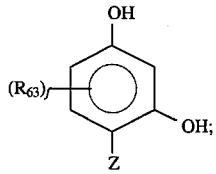

wherein $R_{41}$ represents an alkyl group, an aryl group, or a heterocyclic group, $R_{42}$ represents an aryl group or a heterocyclic group, $R_{43}$, $R_{44}$, and $R_{45}$ each represents a hydrogen atom, an alkyl group, an aryl group, or a heterocyclic group; $R_{51}$ has the same meaning as $R_{41}$; $R_{52}$ and $R_{53}$ each has the same meaning as $R_{43}$, b represents 0 or 1; $R_{54}$ represents the group same as $R_{41}$, an $R_{41}CO(R_{43})N$— group, an $R_{41}SO_2(R_{43})N$— group, an $R_{41}(R_{43})N$— group, an $R_{41}S$— group, an $R_{43}O$— group, or an $R_{45}(R_{43})NCON(R_{44})$— group; $R_{55}$ has the same meaning as $R_{41}$; $R_{56}$ and $R_{57}$ each represents the group same as $R_{43}$, an $R_{41}S$— group, an $R_{43}O$— group, an $R_{41}CO(R_{43})N$— group, an $R_{41}SO_2(R_{43})N$— group, an $R_{41}(R_{43})N$—, or an $R_{45}(R_{43})NCON(R_{44})$— group; $R_{58}$ has the same meaning as $R_{41}$; $R_{59}$ represents the same group as $R_{41}$, an $R_{41}CO(R_{43})N+$ group, an $R_{41}OCO(R_{43})N$— group, an $R_{41}SO_2(R_{43})N$— group, an $R_{43}(R_{44})NCO(R_{45})N$— group, $R_{41}O$— group, an $R_{41}S$— group, a halogen atom, or an $R_{41}(R_{45})N$— group; d represents 0 or an integer of from 1 to 3; when d is 2 or 3, plural $R_{59}S$ may be same or a different; $R_{60}$ has the same meaning as $R_{41}$; $R_{61}$ has the same meaning as $R_{41}$; $R_{62}$ represents the same group as $R_{41}$, an $R_{41}OCONH$— group, an $R_{41}OCONH$— group, an $R_{41}SO_2NH$— group, an $R_{43}(R_{44})NCONH$— group, an $R_{43}(R_{44})NSO_2NH$— group, an $R_{43}O$— group, an $R_{41}S$— group, an $R_{41}CO(R_{43})NSO_2$— group, a halogen atom, or an $R_{41}NH$— group; $R_{63}$ represents the same group as $R_{41}$, an $R_{43}CO(R_{44})N$— group, an $R_{43}(R_{44})NCO$— group, an $R_{41}SO_2(R_{43})N$— group, $R_{41}(R_{43})NSO_2$— group, an $R_{41}SO_2$— group, an $R_{43}OCO$— group, an $R_{43}O$—$SO_2$— group, a halogen atom, a nitro group, a cyano group, or an $R_{43}CO$— group; e represents 0 or an integer of from 1 to 4, f represents 0 or an integer of from 1 to 3; when $R_{62}$ or $R_{63}$ is plural, they may be the same or different; and Z represents —$(LINK)_n$—$N(R_1)$—$Ar(OR_2)$—X of formula (I); said groups represented by $R_{51}$ to $R_{63}$ may represents a divalent group to form a bis type coupler residue, a telomer type coupler residue, or a polymer type coupler residue.

5. The silver halide color photographic material as claimed in claim 1, wherein Link is a linking group selected from the group consisting of groups represented by formulae (T-1) and (m-2):

$$*—W—(Y=Z)_j—C(R_{21})R_{21}—** \quad \text{(T-1)}$$

$$*—W—R_3—E—** \quad \text{(T-2)}$$

wherein * represents the position at which LINK is connected to Cp in the general formula (I);  represents the position at which LINK is connected to 13** $N(R_1)$—$Ar(OR_2)$—X or LINK (when n is plural); W represents an oxygen atom, a sulfur atom or >N—$R_{23}$; Y and Z each represent a methine or a nitrogen atom; j represents 0 or an integer of from 1 or 2; $R_{21}$, $R_{22}$ and $R_{23}$ each represent a hydrogen atom or a substituent; E represents an electrophilic group; and $R_3$ represents a linking group which makes a steleostructual relationship between W and E so that they can undergo intramolecular nucleophilic substitution reaction, with the proviso that when Y and Z each represent a substituted methine group, any two of the substituents, $R_{21}$, $R_{22}$ and $R_{23}$ may be connected to each other to form a cyclic structure.

6. The silver halide color photographic material as claimed in claim 1, wherein Link releases two —$N(R_1)$—$Ar(OR_2)$—X moieties.

7. The silver halide color photographic material as claimed in claim 1, wherein Link is a linking group selected from the group consisting of

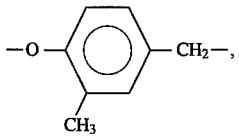

-continued

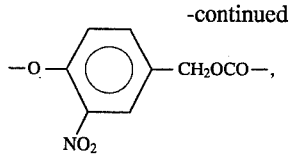

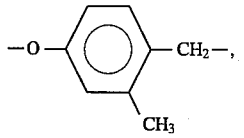

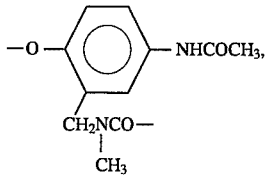

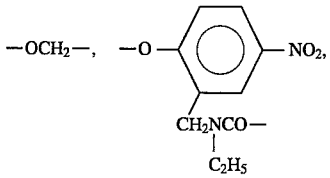

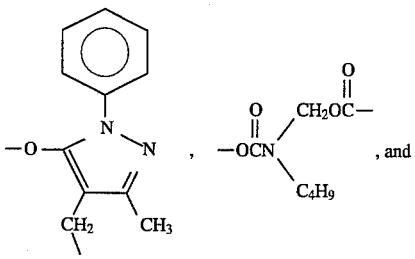

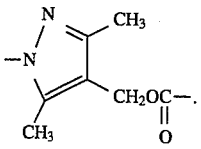

8. The silver halide color photographic material as claimed in claim 1, wherein the substituent represented by $R_1$ is selected from the group consisting of an alkoxycarbonyl group, an unsubstituted sulfamoyl group, an alkyl-, aryl- and N-acyl- sulfamoyl group, a sulfonyl group, an alkyl group, an aryl group, and an acyl group, said substituents may be further substituted with at least one of said substituents.

9. The silver halide color photographic material as claimed in claim 1, wherein the arylene group represented by Ar is an arylene group having no substituent other than $OR_2$ or an arylene group which is further substituted with at least one substituent selected from the group consisting of a halogen atom, an acylamino group, a sulfonamido group, an alkoxy group, an aryloxy group, an alkoxycarbonylamino group, —COOM and $SO_3M$ (wherein M represents a hydrogen atom, an alkali metal atom, or $NH_4$), a hydroxy group, an alkylthio group, a ureido group, an aryl group, heterocyclic group, an alkyl group, an arylthio group, and a sulfamoylamino group; said substituents may be further substituted with at least one of said substituents.

10. The silver halide color photographic material as claimed in claim 1, wherein $R_2$ represents an unsubstituted aryl group or an aryl group substituted with at least one substituent selected from the group consisting of an alkyl group, an alkoxy group, and a halogen atom.

11. The silver halide color photographic material as claimed in claim 1, wherein the amino group represented by X is an unsubstituted amino group, an alkyl- substituted amino group, or an aryl- substituted amino group; said alkyl-substituted amino group and aryl- substituted amino group may be further substituted with at least one substituent selected from the group consisting of a halogen atom, an acylamino group, a sulfonamido group, an alkoxy group, an aryloxy group, an alkoxycarbonylamino group, —COOM and $SO_3M$ (wherein M represents a hydrogen atom, an alkali metal atom, or $NH_4$), a hydroxy group, an alkylthio group, a ureido group, an aryl group, heterocyclic group, an alkyl group, an arylthio group, and a sulfamoylamino group; said substituents may be further substituted with at least one of said substituents.

12. The silver halide color photographic material as claimed in claim 1, wherein X is an alkyl-substituted amino group or an alkoxy group and a carbon atom of said alkyl-substituted amino group or said alkoxy group is connected with a carbon atom adjacent to the X-connected carbon atom of the arylene group represented by Ar to form a 5- to 7-membered ring.

13. The silver halide color photographic material as claimed in claim 1, wherein said arylene group represented by Ar is a phenylene group having no substituent other than $OR_2$ or a phenylene group further substituted with at least one substituent selected from the group consisting of an alkyl group, an alkoxy group, and an acylamino group.

14. The silver halide color photographic material as claimed in claim 1, wherein said arylene group represented by Ar is a substituted or unsubstituted 1,4-phenylene group or a 1,4-naphthylene group.

15. The silver halide color photographic material as claimed in claim 1, wherein X is an alkyl- substituted amino group.

16. The silver halide color photographic material as claimed in claim 1, wherein $R_1$ is a hydrogen atom or a sulfonyl group.

17. The silver halide color photographic material as claimed in claim 1, wherein the coupler represented by formula (I) is incorporated into at least one of said light-sensitive silver halide emulsion layer(s) and the layer(s) adjacent to the light-sensitive silver halide emulsion layer(s).

18. The silver halide color photographic material as claimed in claim 1, wherein the coupler represented by formula (I) is incorporated into said at least one light-sensitive silver halide emulsion layer.

19. The silver halide color photographic material as claimed in claim 1, wherein the coupler represented by formula (I) is incorporated into the silver halide photographic material in an amount of from 0.0001–1.50 g/m$^2$.

20. The silver halide color photographic material as claimed in claim 2, wherein Cp represents a cyan color image-forming coupler residue.

21. The silver halide color photographic material as claimed in claim 1, wherein $R_z$ represents an alkyl group.

22. The silver halide color photographic material as claimed in claim 1, wherein X is dimethylamino, diethylamino, N-ethyl-N-methanesulfonamidoethylamino, N-ethyl-N-hydroxyethylamino, N,N-bis(3-hydroxypropyl)amino, N,N-bis(2-hydroxyethyl)amino, dipropylamino, N-methyl-N-ethylamino, morpholino, pyrrolidino, or dibutylamino).

23. A method for processing a silver halide color photographic material having on a support at least one silver halide emulsion layer, which comprises exposing, developing, and bleaching the photographic material, wherein the replenishing amount for the developer is not more than 600 ml per square meter of the photographic material, and said photographic material contains a nondiffusing coupler represented by formula (I):

$$Cp—(LINK)_n—N(R_1)—Ar(OR_2)—X \quad (I)$$

wherein Cp represents a coupler residue (residual group) which can undergo coupling reaction with the oxidation product of a color developing agent to release $—(LINK)_n—N(R_1)—Ar(OR_2)—X$; LINK represents a group which can release $—N(R_1)—Ar(OR_2)—X$ after cleavage of bond to Cp; n represents 0 or an integar of 1 or 2, Ar represents an arylene group; X represents an amino group, an alkoxy group or a hydroxyl group; $R_1$ represents a hydrogen atom or a substituent: $R_2$ represents an alkyl group or an aryl group; and X and N are located para relative to each other.

24. The method for processing the silver halide color photographic material as claimed in claim 23, wherein the time for color development is not more than 60 seconds.

* * * * *